US008863831B2

(12) United States Patent
Bassa

(10) Patent No.: US 8,863,831 B2
(45) Date of Patent: Oct. 21, 2014

(54) FREE MANDREL SYSTEM, PROTECTED CASING

(76) Inventor: Eladio Juan Bassa, Mendoza (AR)

( * ) Notice: Subject to any disclaimer, the term of this patent is extended or adjusted under 35 U.S.C. 154(b) by 254 days.

(21) Appl. No.: 13/067,295

(22) Filed: May 23, 2011

(65) Prior Publication Data

US 2012/0090829 A1 Apr. 19, 2012

(30) Foreign Application Priority Data

Oct. 13, 2010 (AR) ..... P100103745

(51) Int. Cl.

| | |
|---|---|
| ***E21B 23/00*** | (2006.01) |
| ***E21B 33/068*** | (2006.01) |
| ***E21B 23/08*** | (2006.01) |
| ***E21B 43/16*** | (2006.01) |
| ***E21B 23/10*** | (2006.01) |

(52) U.S. Cl.

CPC ..... *E21B 23/08* (2013.01); *E21B 33/068* (2013.01); *E21B 43/162* (2013.01); *E21B 23/10* (2013.01)

USPC ..... 166/85.5

(58) Field of Classification Search

USPC ..... 166/85.5

See application file for complete search history.

(56) References Cited

U.S. PATENT DOCUMENTS

| | | | | |
|---|---|---|---|---|
| 4,050,516 | A * | 9/1977 | Canterbury | 166/305.1 |
| 4,433,729 | A * | 2/1984 | Sydansk | 166/270 |
| 4,462,465 | A * | 7/1984 | Strickland | 166/117.5 |
| 4,671,352 | A * | 6/1987 | Magee et al. | 166/186 |
| 2004/0238218 | A1 * | 12/2004 | Runia et al. | 175/57 |
| 2005/0011678 | A1 * | 1/2005 | Akinlade et al. | 175/72 |

* cited by examiner

*Primary Examiner* — Giovanna Wright

(57) ABSTRACT

The Free Mandrel System, Protected Casing is to be applied in the petroleum industry for selective injection of fluids, liquids or gases, in different formations while keeping the casing isolated from fluid pressure. As it is hydraulically driven by the injection fluid, an operator can handle the provided surface valves. The system includes five assemblies: Surface, Transport, Free Mandrel, Fixed Bottom Hole and Complementary. The Free Mandrel Assembly is the dynamic main device that carries all the Injection valves together, one for each formation, from the Fixed Bottom Hole to the surface in 30' and vice versa. As this operation is performed many times in the well lifetime, it allows a cumulative time and money saving. Workover equipment is only used for installing the system and for fixing the required packers. Formation Pressure is kept at any time when the system is either operated, set up, or pulled up.

9 Claims, 27 Drawing Sheets

Cross sectional III-III

Cross sectional IV-IV

Cross sectional V-V

Cross sectional VI-VI

Cross sectional VII-VII

Cross sectional VIII-VIII

Cross sectional I-I

Cross sectional II-II

FREE MANDREL SYSTEM, PROTECTED CASING

CROSS-REFERENCE TO RELATED APPLICATIONS

Argentine Record No P 2010 0103745

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable

BACKGROUND OF THE INVENTION

1—Field of the Invention

This invention is related to elements employed in the petroleum industry in general but it particularly refers to a Free Mandrel System with protected casing. Its main specific purpose is to be applied to petroleum exploitation for the multiple selective injection of fluids, liquids or gases, in different formations of an injection well.

2—Description of Related Art

The present state of technology of mandrel systems for the injection of fluids in several formations only use fixed installations at the bottom hole. Consequently, when it is necessary to repair or replace any of the injection valves placed inside the mandrel, they have to be brought up to the surface. In order to perform this operation, the well has to be depressurized so injection has to be stopped; each of the injection valves have to be raised one at a time from the bottom hole to the surface. After the necessary repair or replacements are made, each of the injection valves have to be lowered again one at a time, and only after they are re-installed, production is resumed. All of the above mentioned operations require not only specialized equipment and personnel but also, down time, during which the well is not operating, and lead time, between order and arrival of the equipment at the well site to start with the operations.

The following documents are related to the present invention:

| | Document Number | Date | Name | Classification |
|---|---|---|---|---|
| A | U.S. Pat. No. 4,671,352 | June 1987 | Magee Jr. et al | 166-334 |
| B | U.S. Pat. No. 4,462,465 | July 1984 | Strickland | 166-334 |
| C | U.S. 2004238218(A1) | December 2004 | Runia. Douwe Johannes et al. | E21B/60— |
| D | U.S. 2005011678(A1) | January 2005 | Akinlade Monsuru Olatunji et al. | E21B21/00— |
| E | U.S. Pat. No. 4,050,516(A) | September 1977 | Canterbury Robert Houston | E21B34/06— |
| F | U.S. Pat. No. 4,433,728 (A) | February 1984 | Sydansk Robert D et al | C09K8/50— |
| G | U.S. Pat. No. 4,433,729 (A) | February 1984 | Sydansk Robert D | C09K8/50 |
| H | RU2002126207 (A) | February 2004 | Stedzhemejer Dzhordzh Leo et al | E21B43/00 |

BRIEF SUMMARY OF THE INVENTION

The main object of the invention is a Free Mandrel System, Protected Casing which enables selective injection in several well formations, the setting up and simultaneous lifting of all Injection Valves installed in the well from the surface by using the injection fluid as power fluid. This process is performed by one operator without any kind of help, assistance or tool, only operating the valves of a surface component of the invention.

In the present explanation for the embodiment of the invention, the Free Mandrel System is applied to a 139.5 mm (5"½) casing and it has been simplified to only two formations, an upper and a lower one, to facilitate the explanation and comprehension of its constructive layout structure which comprises five Assemblies: A Surface Assembly (SA), A Transport Assembly (TA), the Free Mandrel Assembly (FMA), a Fixed Bottom Hole Assembly (FBHA) and a Complementary Assembly (CA).

(A) The Surface Assembly (SA) made up of an installation Mast (4), a Lubricator (3) with a Catcher (2) to release and catch the Free Mandrel Assembly (FMA), Standard Valves ($\mathbf{6}_1$,$\mathbf{6}_2$, $\mathbf{6}_3$,$\mathbf{6}_4$, $\mathbf{6}_5$), Standard Retention Valve (7) and the Impeller Circulation Pump (5).

(B) The Transport Assembly (TA) made up of a Fishing Neck with a Retention Valve, two Rubber Cups, which slide over a central tube, and a Lower Connector.

(C) The Free Mandrel Assembly (FMA), it is the main dynamic element of the System comprising one mandrel for every formation to be selectively injected (only two in this simplified case), where each mandrel lodges its corresponding Injection Valve. The Free Mandrel Assembly has as many mandrels as formations an injection well may have.

(D) The Fixed Bottom Hole Assembly (FBHA), which is the device that is screwed to the bottom of the 73.026 mm (2"⅞) tubing (9) string and over the On-Off Sealing Connector (43). When the FMA is inserted into the FBHA, the FMA complements the hydraulic circuits they both contain to accomplish selective injection in every formation. These two Assemblies are composed of designed-to-measure parts and are the core of the Invention.

(E) A Complementary Assembly (CA), which is screwed to the lower part of the FBHA (D), and comprises several parts, some of them are standard and others are specifically designed to build the fluid circuit required for the operation of the Free Mandrel System, Protected Casing. The CA (E) is screwed in its interior part to the central and lower end of the Fixed Bottom Hole Assembly FBHA (D); the Telescopic Union Inner Body (37); the Telescopic Union Outer Body (39) and the Injector Tube (40). All of these parts have been specifically designed for the Free Mandrel System, Protective Casing.

In its exterior part, the Complementary Assembly CA (E) is made up of the upper end of the On-Off Sealing Connector (43) screwed to the outer and lower end of the Fixed Bottom Hole Assembly FBHA (D). The lower end of the On-Off Sealing Connector (43) is screwed to the upper end of the Upper Packer F. H. (44) (standard parts) while the Injector Plug (41) (designed-to-measure part) is screwed at its lower end.

To complete the installation, the 60.325 mm (2"3/8) tubing (47) string is screwed to the lower end of the Injector Plug (41)*to* fix the Lower Packer F.H. (46) in the adequate position to separate both formations. The 60.325 mm (2"3/8) tubing (47) string is screwed to the upper end of the Lower Packer F.H. (46)

One or two 60.325 mm (2"3/8) tubing are placed below the Lower Packer F.H. (46), and the Shear Out (48) is placed on its end (standard parts)

With this invention, the problems which derive from a fixed mandrel system are advantageously solved because the complete Free Mandrel Assembly FMA (C) is raised containing all the Injections valves that the injection well requires.

The Free Mandrel Assembly FMA (C) is not fixed to the bottom of the well, it is free and travels through the tubing from the FBHA (D) (upstroke) to the surface and vice versa, driven by the Injection fluid which is used as power fluid.

An additional advantage is that fluid injection is continuously pressurized in all formations so injection is not interrupted in any of the operational stages. That is to say, the fundamental purpose of fluid injection (secondary recovery) is to pressurize the formations to achieve a larger formation volume in the surrounding or adjacent producing wells. An important time and extra hand work advantage is achieved because no additional equipment such as Wireline, slikeline, or external personnel is not required for valve setting up or removal. This operation can be performed by control personnel of injector wells (either the operator or field supervisor) from the surface by handling the well head manifold valves at the moment it is required.

Consequently, for example, for 2500 m deep installations, the FMA (C) described herein reaches the surface with all valves installed in about 30 minutes and requires a slightly shorter time in the down stroke. Both strokes are attained with the same injection fluid, used as power fluid. This advantage is utilized several times while the well is producing, thus, accumulatively, adding a significant value.

Free Mandrel System, Protected Casing allows obtaining samples of the material deposited in the tubing string. With that purpose, strokes can be performed to bring the material to the surface to be analyzed.

Strokes can be performed to verify the accumulated depositions and in increasing periods, that is to say, beginning with short periods and increasing them in order to define the most suitable one for each well without depressurizing the formations, and with no additional equipment or external personnel costs.

To maximize the Casing (10) protection in case of long injection periods without replacing injection valves, Casing Protection fluid can be replaced from the surface by the well operator without employing pulling equipment to disconnect the On-Off Sealing Connector (43).

Besides, it can block any formation to examine or stimulate others. This is achieved by removing the FMA (C), leaving the formation circuits in service and blocking one of them, or leaving one formation in service and blocking the remaining ones.

For the two Formations used in this example, in the Upper Mandrel we can install a Blind Upper Injection Valve (51) and inject in the Lower Formation using the Lower Formation Injection Valve (21) (FIG. 11). We can also use a Blind Lower Injection Valve (52) and inject only in the Upper Formation installing the Upper Formation Injection Valve (18)(FIG. 9)

This also allows determining if there is any interference between the formations by injecting fluid (at different pressures and volumes) in one and placing Amerada® Gauge, an instrument to measure pressure in the bottom hole, inside another mandrel to verify pressure variation in different injection flows.

BRIEF DESCRIPTION OF THE SEVERAL VIEWS OF THE DRAWINGS

Here follows a list of the five assemblies which comprise the system, their Components, Vertical Passages and Annular Spaces with their respective reference characters as they will be identified in the detailed description of the system, drawings and claims:

A—Surface Assembly (SA)
B—Transport Assembly (TA)
C—Free Mandrel Assembly (FMA)
D—Fixed Bottom Hole Assembly (FBHA)
E—Complementary Assembly (CA)

Components of the five assemblies:

1—Pipeline from Water Power Plant.
2—Catcher.
3—Lubricator.
4—Mast.
5—Impeller Circulation Pump.
$\mathbf{6}_1$—V1 Standard Valve.
$\mathbf{6}_2$—V2 Standard Valve.
$\mathbf{6}_3$—V3 Standard Valve.
$\mathbf{6}_4$—V4 Standard Valve.
$\mathbf{6}_5$—73.026 mm (2"7/8) Standard Full Passage Injection Valve
7—Standard Retention Valve.
8—Well Head.
9—73.026 mm (2"7/8) Tubing
i—Tubing (9) Interior (Direct)
10—Casing.
11—Fishing Neck.
12—Retention Valve.
13—Rubber Cups.
14—Lower Connector.
15—Outer Jacket.
16—Outer Jacket Seal Ring.
17—Middle Plug.
18—Upper Formation Injection Valve.
19—Middle Plug Radial Passage.
20—Middle Plug Seal Ring.
21—Lower Formation Injection Valve.
22—Lower Plug.
23—Lower Plug Seal Ring.
24—Upper Body.
25—Upper Packer Collar.
26—Upper Packer Collar Seal Ring.
27—Lock Nut.
28—Lower Body.
29—Lower Body Seal Ring.
30—Spacer.
31—Spacer Injection Outlet Perforation.
32—Lower Packer Collar.
33—Lower Packer Collar Seal Ring.
34—Seat.
35—Seat Seal Ring.
36—Casing Protective Valve.
37—Telescopic Union Inner Body.
38—Telescopic Union Seal Ring.
39—Telescopic Union Outer Body.
40—Injection Tube.
41—Injector Plug.

42—Rupture Disc Passage.
43—On-Off Sealing Connector.
44—Upper Packer F.H.
46—Lower Packer F. H.
47—60.325 mm (2"3/8) Tubing
48—Shear Out.
49—Casing Upper Formation Perforations
50—Casing Lower Formation Perforations
51—Blind Upper Injection Valve.
52—Blind Lower Injection Valve- Vertical Passages C1—It is placed in the Middle Plug (17). They are passages in the Free Mandrel Assembly central body C2—It is placed in the Lower Body (FBHA). The Annular Space (e6) where the regulated pressure is discharged through the Upper Valve (18) and conducted to the Annular Space (e9) placed between Telescopic Union Inner Body (37) and the interior of the Fixed Bottom Hole Assembly (D) FBHA eccentric vertical passage C3—Casing Protective Valve (36) Passage C4—Shear Out (48) passage Annular Spaces e1—Between the Casing (10) and the 73.026 mm (2"7/8) Tubing (9)

e2—Between the Casing (10) and the FWBA (D)

e3—Between the Casing (10) and the Injector Plug (41)

e4—Between the Casing (10) and the 60.325 mm (2"3/8) tubing (47)

e5—Between the Casing (10) and the Shear Out (48)

e6—Between the FBHA (D) and the Middle Plug (17)

e7—Between the Upper Mandrel Jacket (15) and the Upper Formation Injection Valve (18)

e8—Between the FBHA (D) interior and the Lower Formation Injection Valve (21)

e9—Between the lower inner part of the FBHA (D) and the Telescopic Union Inner Body (37)

e10—Between the On-Off Sealing Connector (43) and the Telescopic Union Outer Body (39)

e11—Between the Injector Plug (41) and the Injection Tube (40)

Figure 1:
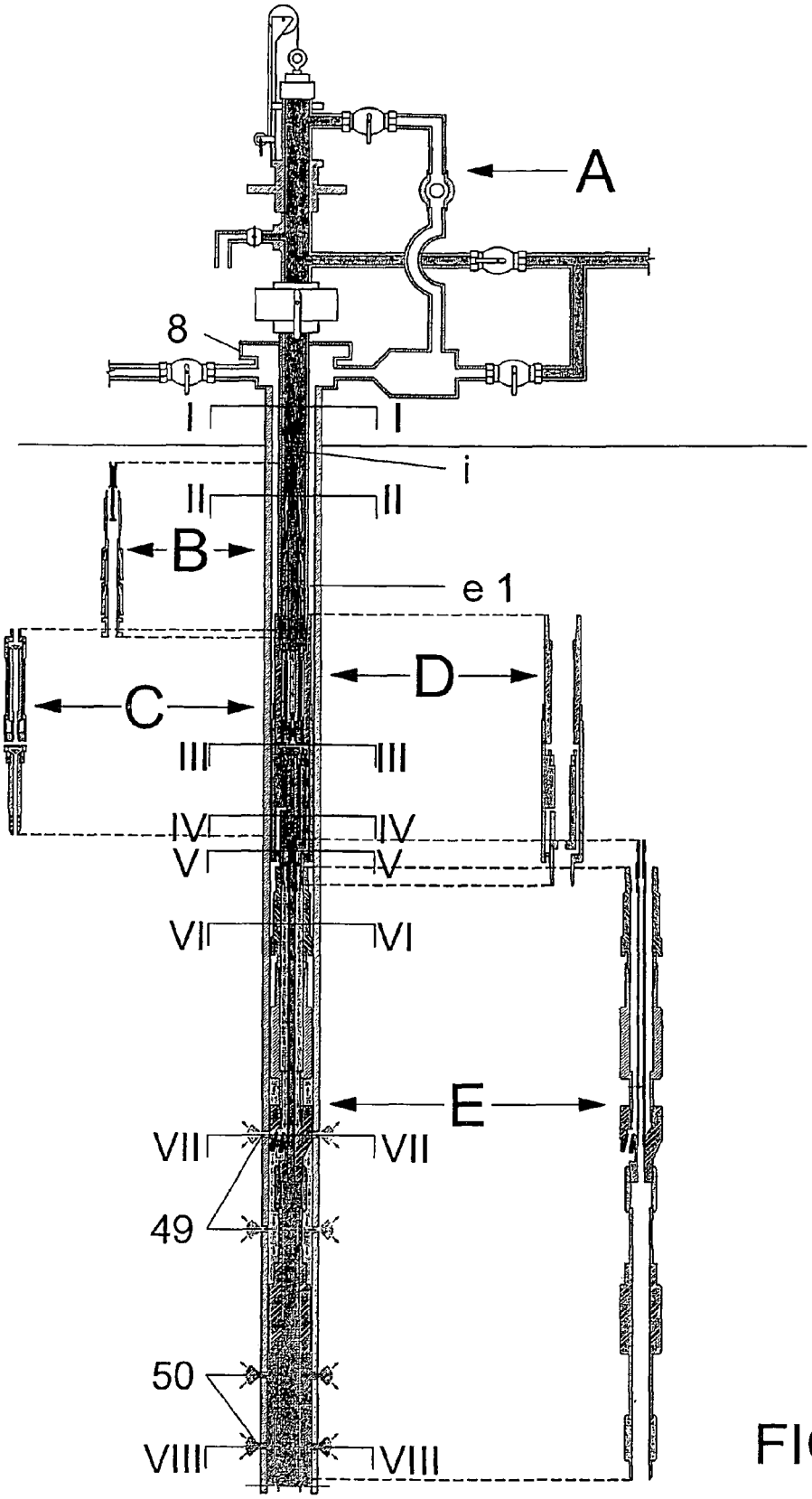

The invention components are schematically represented in 21 different views of FIG. 1. As the component parts of the Free Mandrel System have a great length but a relatively small diameter, the 27 Figures have been deliberately deformed so that the component parts can be distinguished to be explained. With the same purpose, an enlargement of FIG. 1 has been added divided into four partial views of FIG. 1.

In all Figures, except 6 and 22, the following hydraulic flow circulations are identified and described to facilitate the comprehension of the Free Mandrel System, Protected Casing operations:

1—Injection fluid, provided by the Power Plant with the highest pressure flowing into all injection valves to be regulated according to the conditions of every formation.

2—Controlled fluid to be injected in the upper formation. It comes out through the lower end of the Upper Formation Injection Valve (18)

3—Controlled fluid to be injected in the lower formation. It comes out through the lower end of the Lower Formation Injection Valve (21)

4—Fluid injected at low pressure through the Annular Space (e1)) to achieve the upstroke of the Free Mandrel Assembly, containing all the Injection Valves required by the well. The pressure is approximately 2 or 3 kg/cm$^2$. (Obviously the higher the pressure, the faster the return speed, but the mentioned pressure is the recommended one). Again, 30' return time is achieved in a 2500 m deep installation.

5—Fluid removed from the tubing as the Free Mandrel Assembly moves up to the surface. Its pressure is slightly lower than the one that pushes up the Free Mandrel Assembly.

6—White (empty space)=Settled fluid or only with hydrostatic pressure (for example in the Annular Space between the Casing (10) and the 70.026 mm (2"7/8) tubing (9) during the injection process).

Figure 1A:
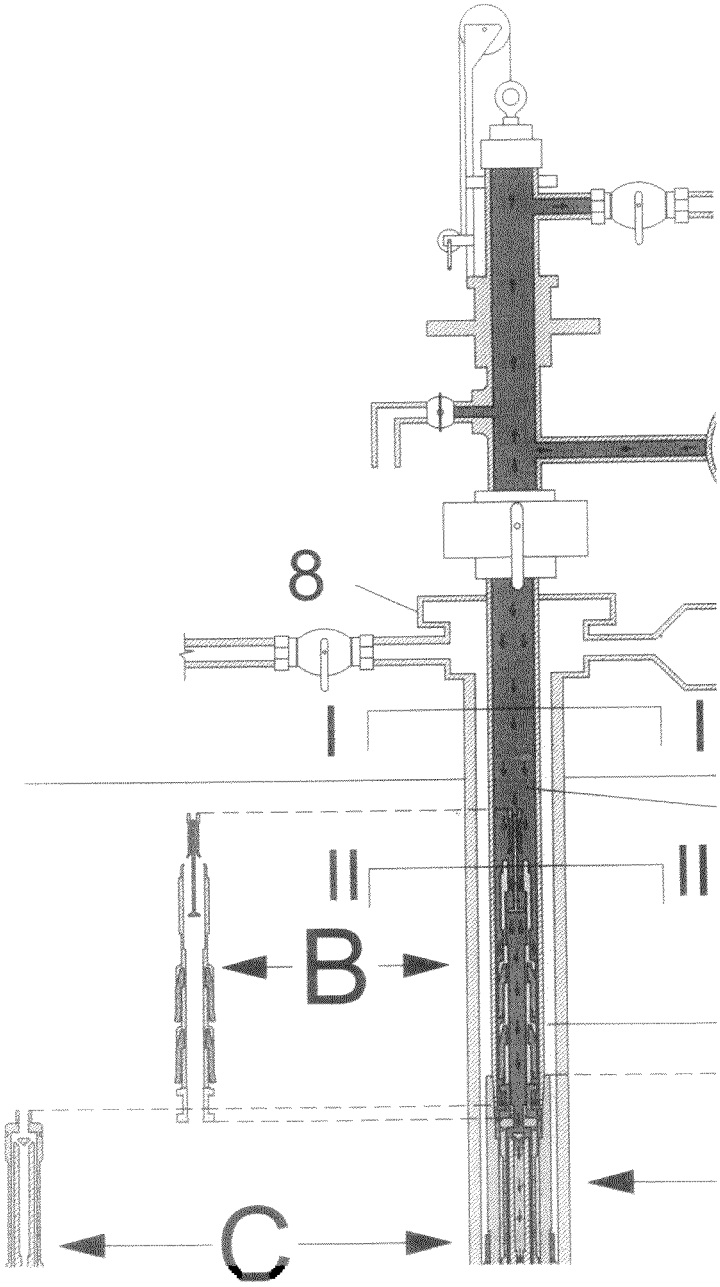
Figure 1B:
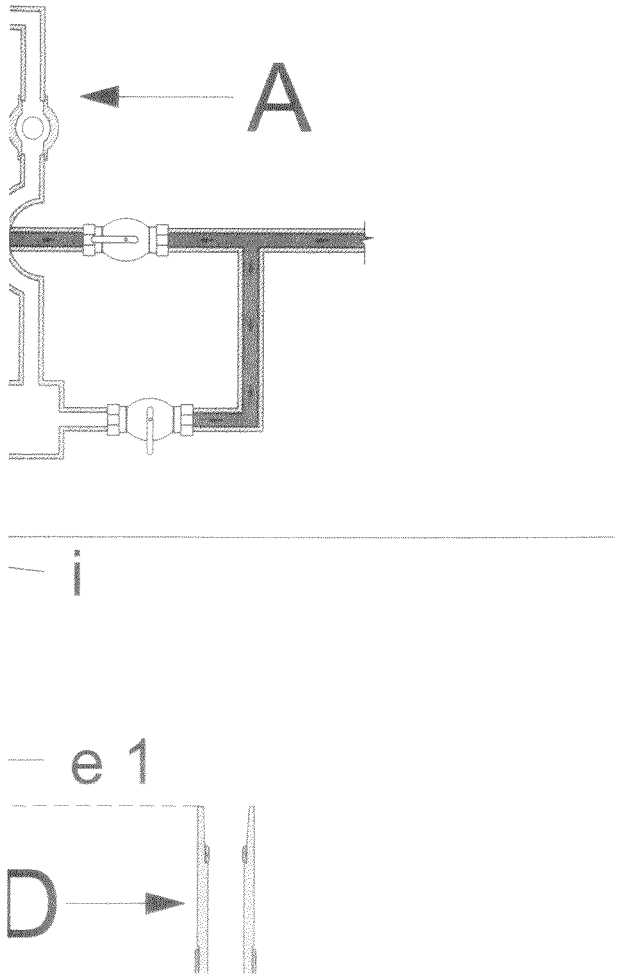
Figure 1C:
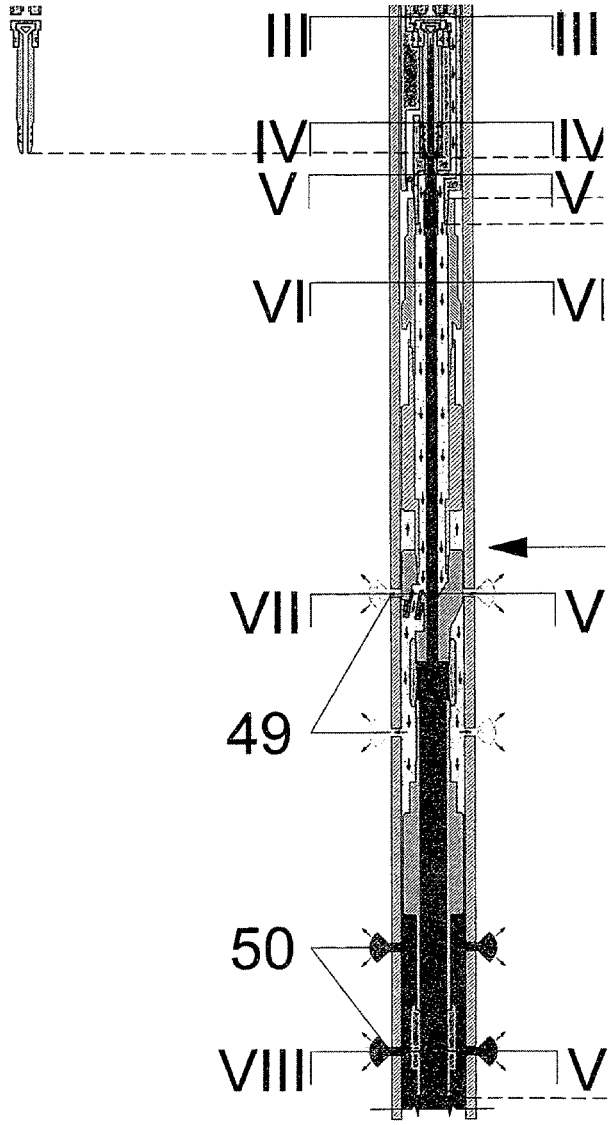
Figure 1D:
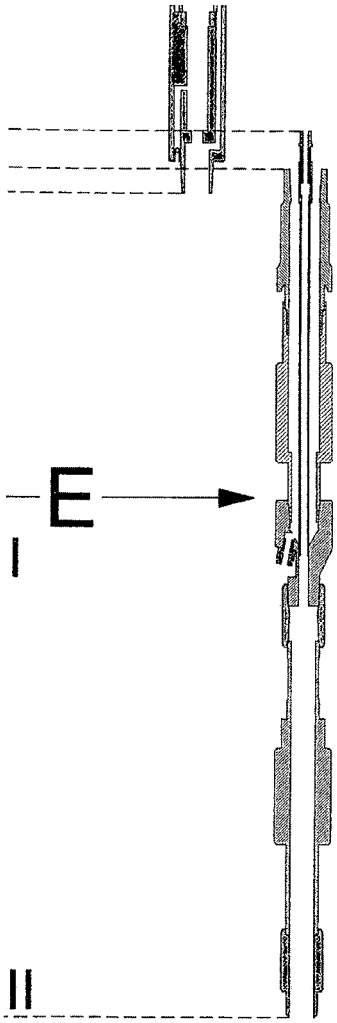

The 22 Figures are as follows:

FIG. 1 is an elevational longitudinal view of the general layout of the invention. The view of the Free Mandrel System, Protected Casing in its entirety (FIG. 1) has also been broken into four partial views to facilitate the understanding of the view (FIG. 1*a*: top left side, FIG. 1*b*: top right side, FIG. 1*c*: bottom left side, and FIG. 1*d*: bottom right side). These partial views have been extended over four sheets which can be linked edge to edge so that no partial view contains parts of another partial view.

The position of a series of transverse cross sectional lines, indicated with numbers I to VIII, correspond to cross-sectional views which show fluid flows The capital letters A, B, C, D and E show the position of the five structures that compose the equipment are: Surface Assembly (A); Transport Assembly (B); Free Mandrel Assembly (C); Fixed Bottom Hole Assembly (D); and Complementary Assembly (E). Four exploded views show the four main components that are inside the well:

1 The two free components, the Transport Assembly (TA) (B) and the Free Mandrel Assembly (FMA) (C) are shown on the left.

2 The two fixed components, the Fix Bottom Hole Assembly (FBHA) (D) and the Complementary Assembly (CA) (E) are shown on the right.

Figure 2:
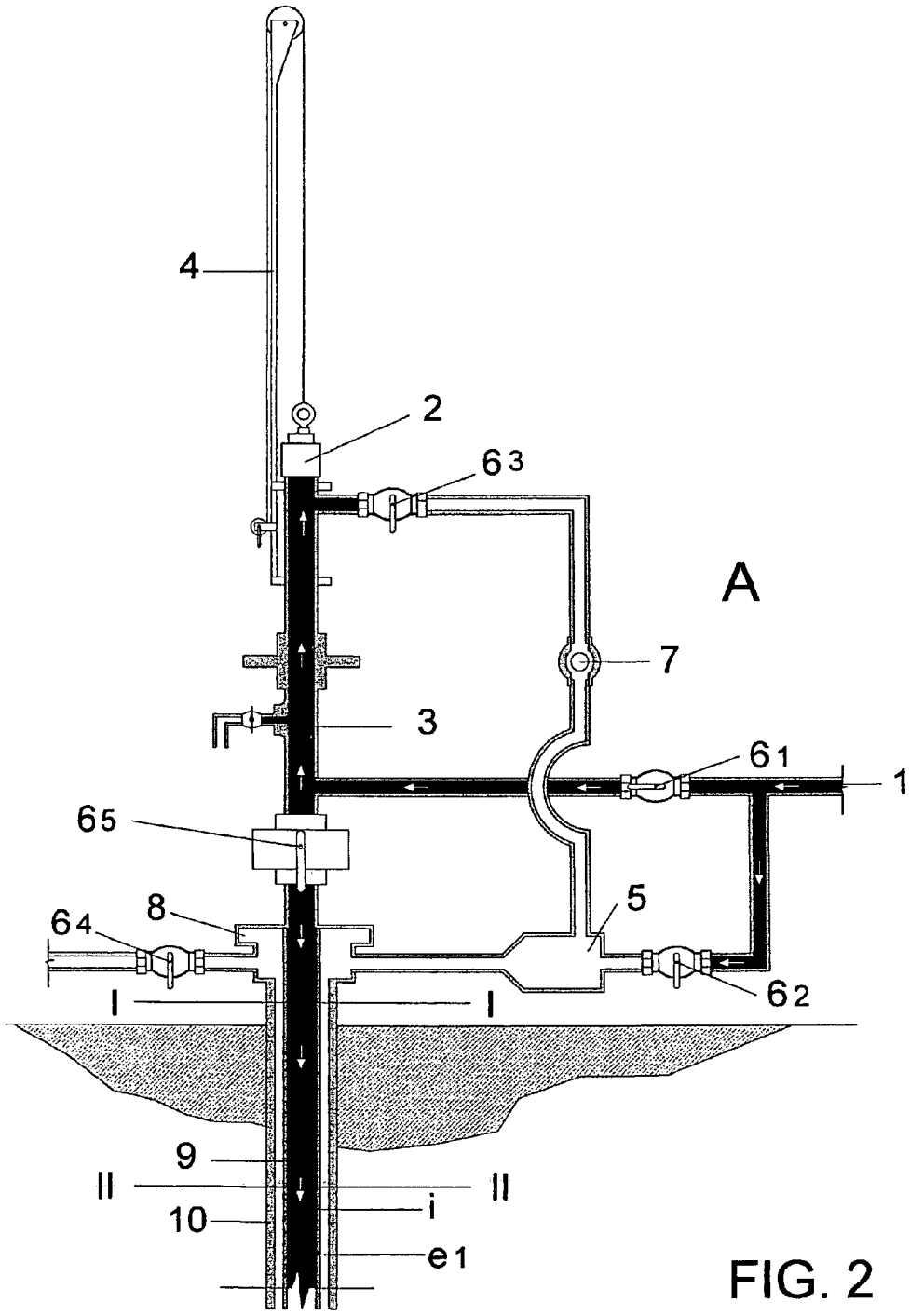

FIG. 2 is an enlarged partial view of the surface section of the Free Mandrel System, Protected Casing where the Surface Assembly (SA (A), the only component of the invention located on the surface of the well site, is shown in detail.

Figure 3:
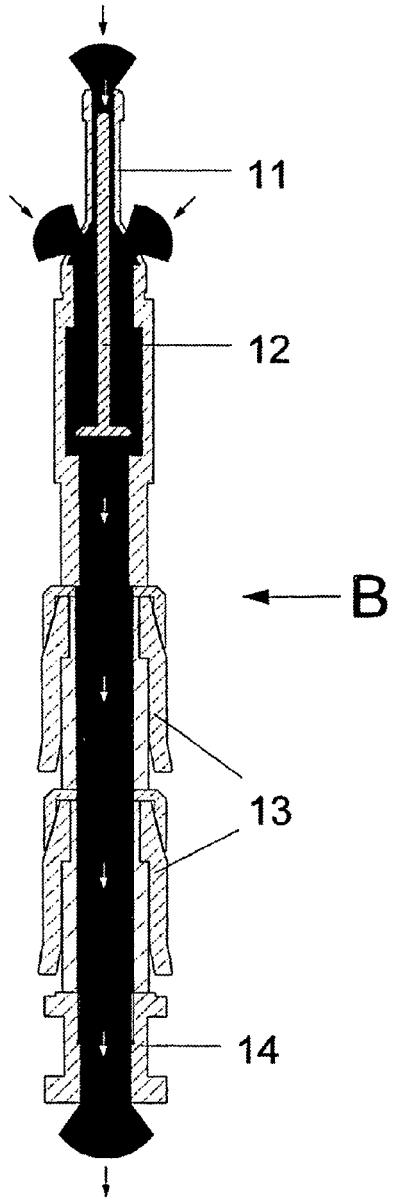

FIG. 3 is an elevational longitudinal view of the Transport Assembly (TA) (B). When the Free Mandrel System, Protective Casing is operating, the only fluid that circulates is the supplied by the Power Plant coming through 73.025 mm (2"7/8) tubing (9) (i), the Fishing Neck (11), Retention Valve (12), and Lower Connector (14), finally connecting with the Free Mandrel Assembly (FMA)(C).

Figure 4:
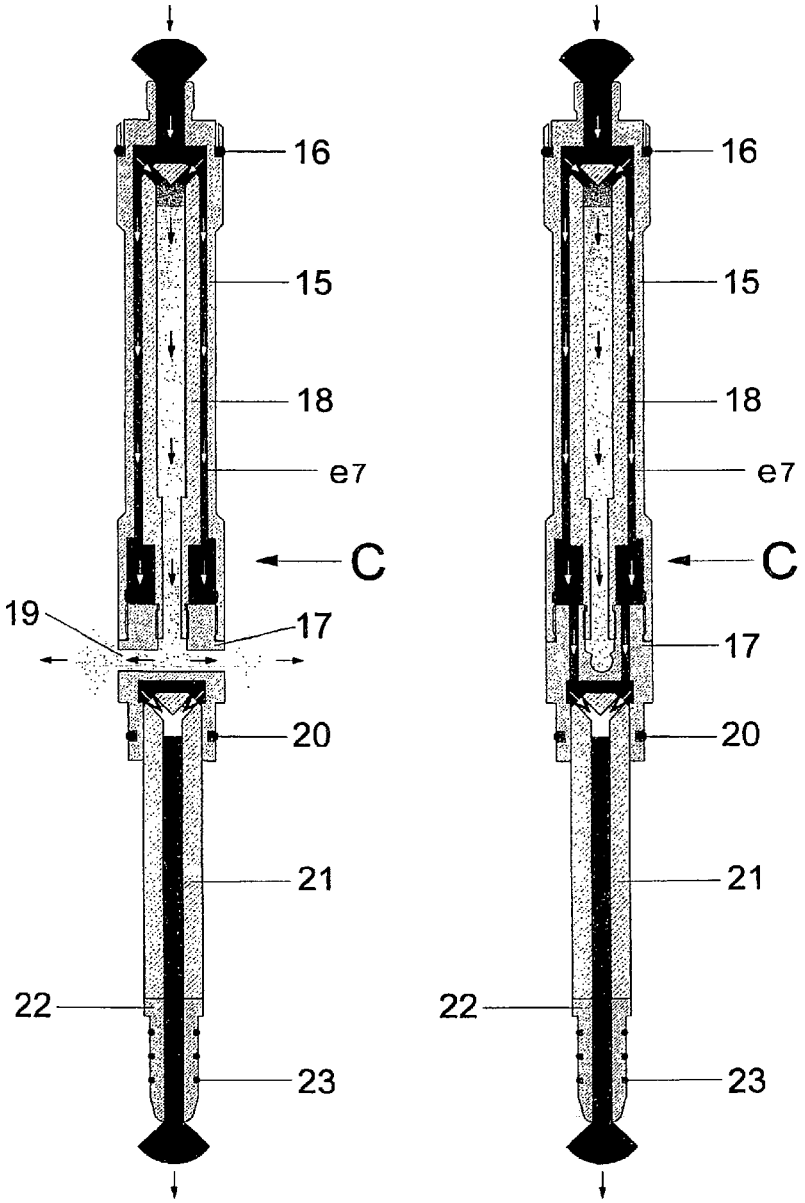

FIGS. 4 A and B are two elevational longitudinal views of the Free Mandrel Assembly (C) Incoming Injection fluid is divided into two streams:

1—FIG. 4 A shows how the fluid flows on the plane of Middle Plug Radial Passage (19). It enters through the upper part of the Outer Jacket (15), goes into the Upper Formation Injection Valve (18) which delivers the controlled fluid to be injected in the Upper Formation through the Middle Plug (17) Radial Passage (19).

2—FIG. 4B. It circulates through the Annular Space (e7) to guide the fluid through the Middle Plug (17) Vertical Passages (C1) and feed with injection fluid to the Lower Injection Formation Valve (21) which delivers the controlled fluid to inject in the Lower Formation through the Lower Plug (22).

Figure 5:
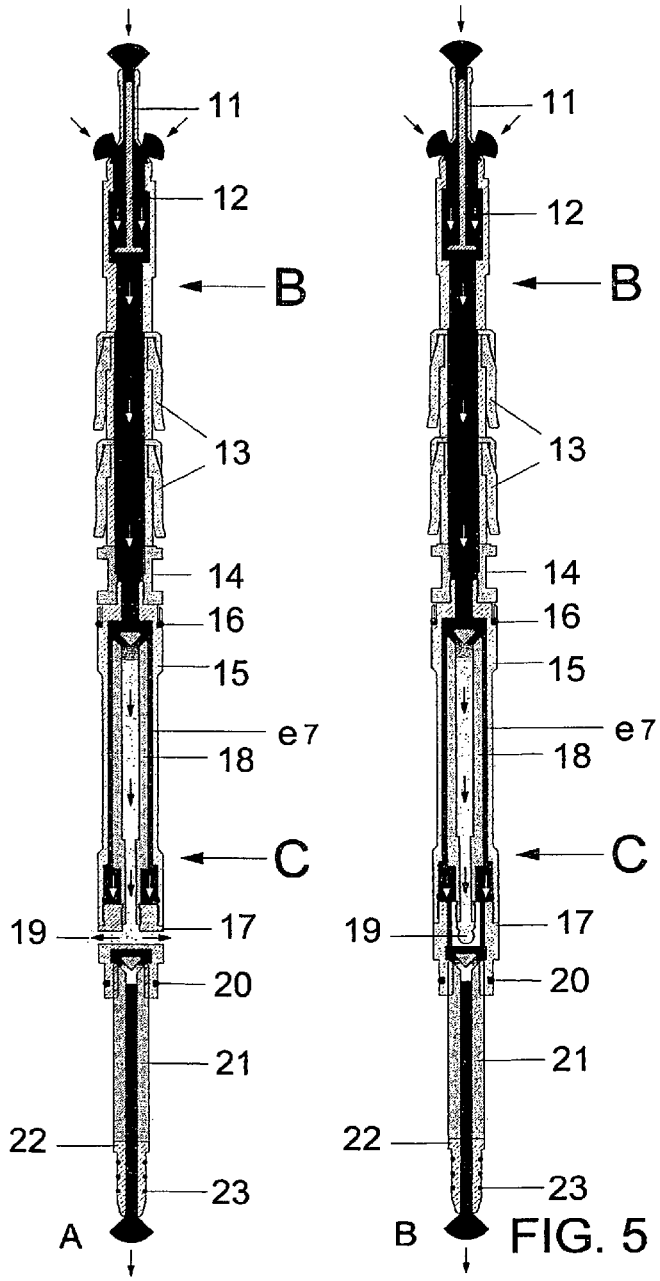

FIGS. 5 A and B are elevational longitudinal views of the Transport Assembly (TA) (B) and the Free Mandrel Assembly (FMA) (C) as they run together through the well from the Catcher (2) to the Fixed Bottom Hole Assembly (FBHA) (D) in their down stroke, and from the Fixed Bottom Hole Assembly (FBHA) (D) to the Catcher (2), in their upstroke. Different fluids are shown inside both assemblies, the incoming injection fluid, the one to be injected in the upper formation and the one to be injected in the lower formation.

FIG. 5 B shows the fluid going through the Middle Plug Radial Passage (19) in a perpendicular plane. Vertical Passages C1, allow the injection fluid go into the Lower Injection Formation Valve (21) to release fluid at the pressure and volume to be injected in the Lower Formation.

Figure 6:
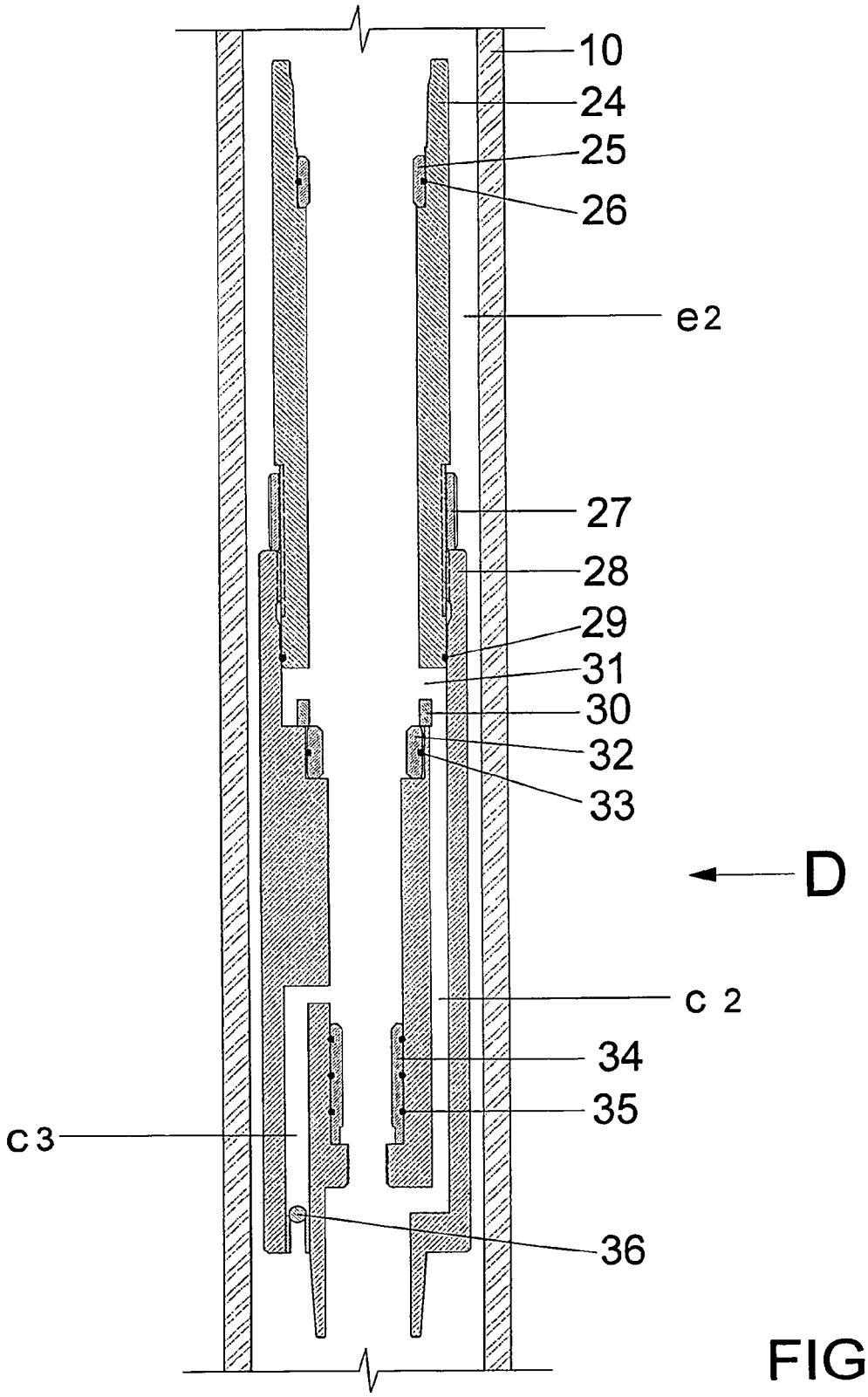

FIG. 6 is an elevational longitudinal view of the Fixed Bottom Hole Assembly (FBHA) (D) with its essential components which are designed-to-measure for the Free Mandrel System, Protected Casing.

Figure 7A:
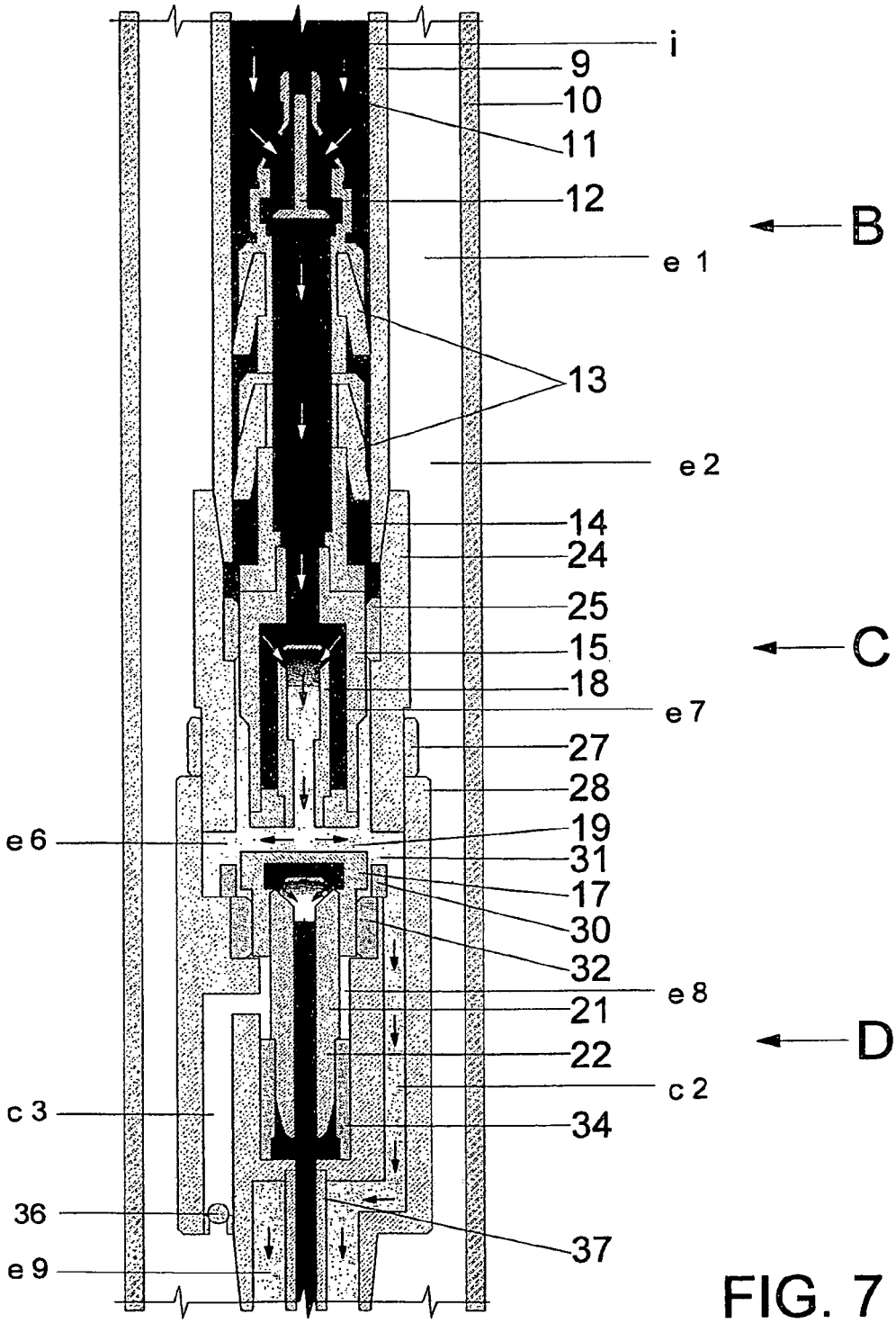
Figure 7B:
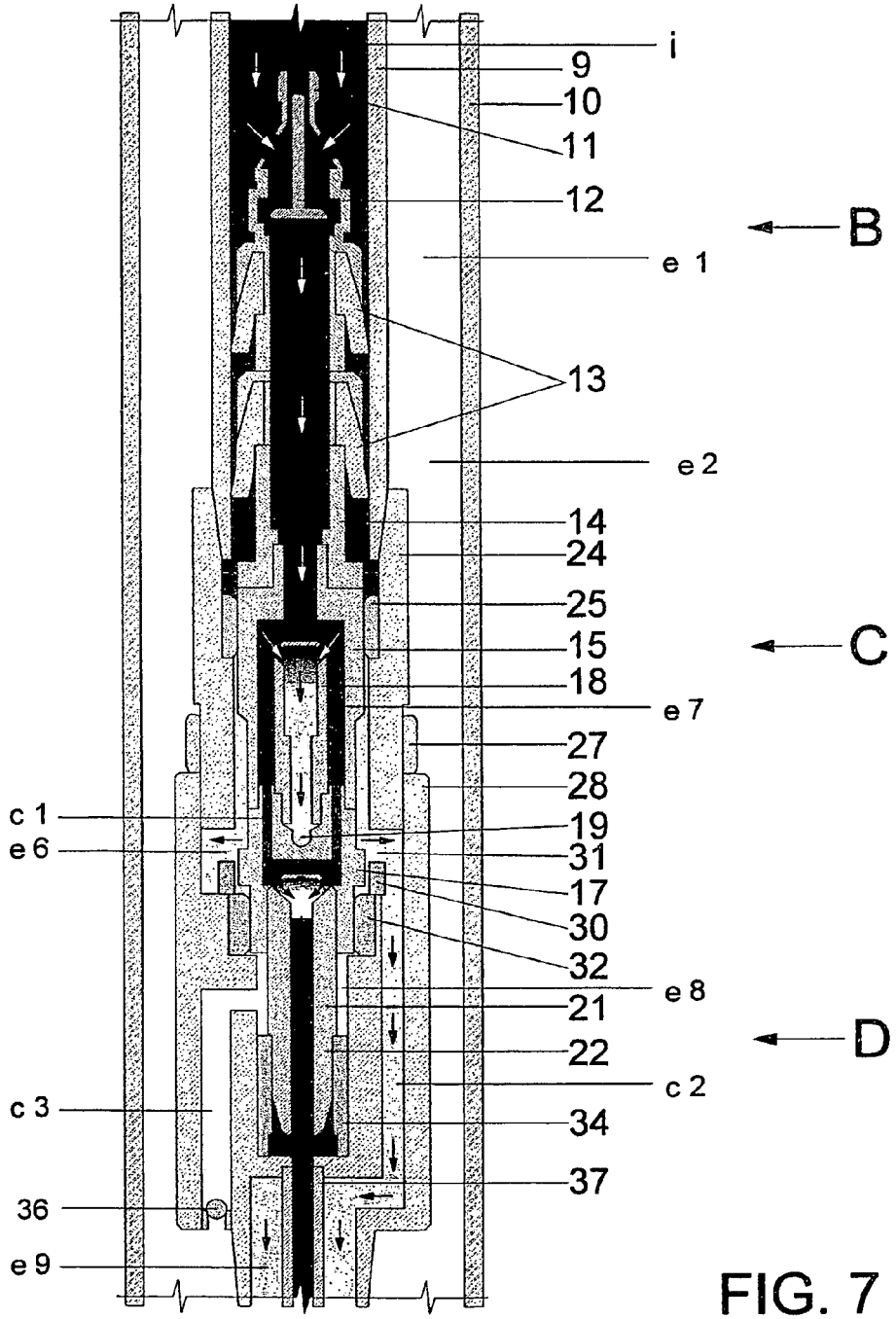

FIG. 7 A is an elevational longitudinal view of the Free Mandrel Assembly (FMA) (C) and Transport Assemblies (TA) (B) inserted in the Fixed Bottom Hole Assembly (FBHA) (D). The injection fluid entering through the 73.025 mm (2"⅞) Tubing (9) i, at the Upper Free Mandrel, the out coming fluid through the Middle Plug (17) Radial Passage (19), to be injected in the Upper Formation, on the plane of Middle Plug Radial Passage (19). FIGS. 7A and 7B are the same Figures but, in 7B, the sectional plane is perpendicular to Radial Passage (19). The incoming Injection fluid flows to the Lower Formation Injection Valve (21) through the Middle Plug (17) Vertical Passages (C1) to be injected in the Lower Formation.

Figure 8:
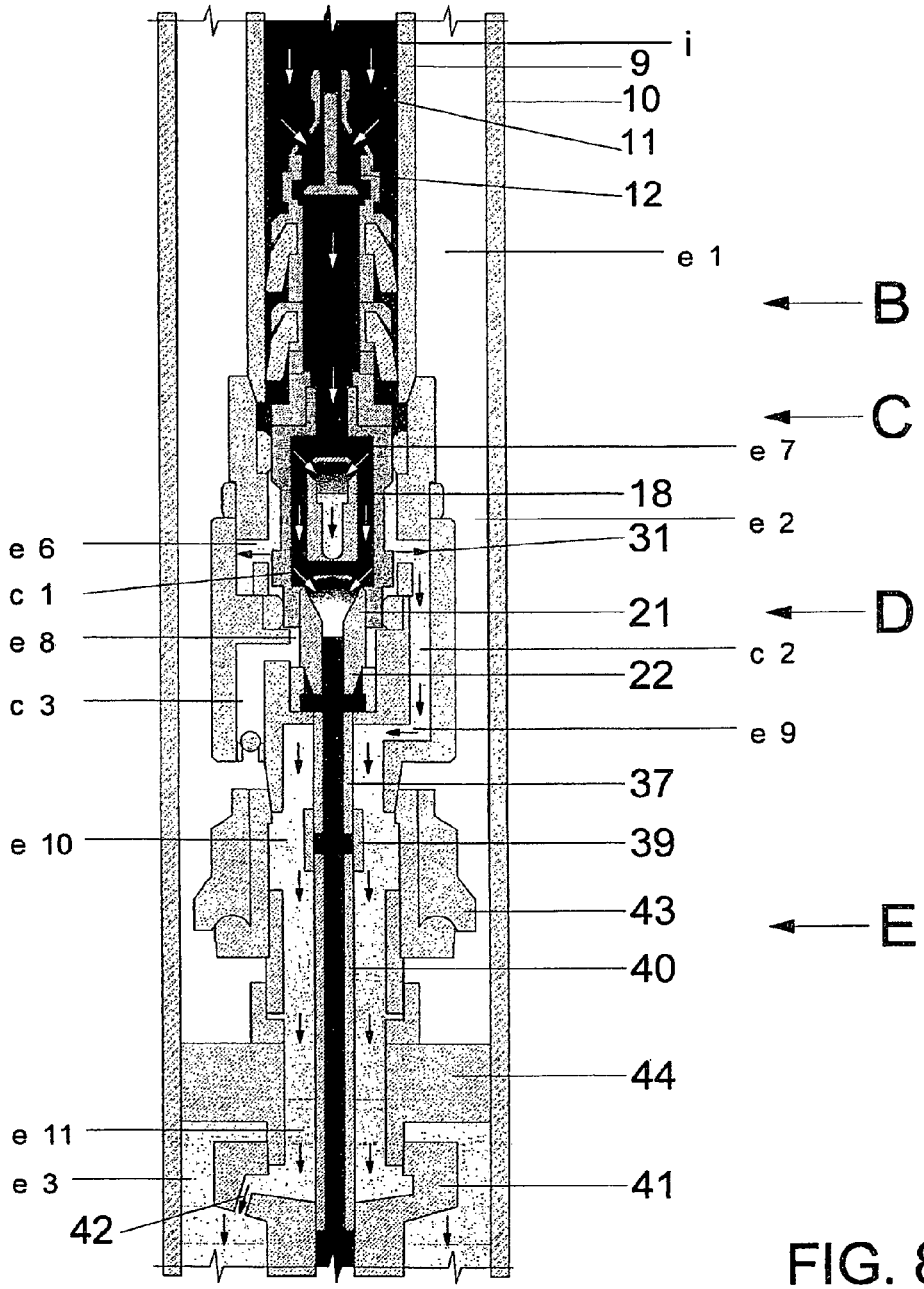

FIG. 8 is an elevational longitudinal view of the Fixed Bottom Hole Assembly (FBHA) (D) screwed to the Complementary Assembly (CA) (E) only down to the Injection Plug (41). The Transport Assembly (TA) (B) together with the Free Mandrel Assembly (FMA) (C) is inserted inside the FBHA (D) during simultaneous injection in both formations. Fluids are also shown as they flow through different passages.

In FIG. 8, the injection circuits of both formations are represented. The injection fluid enters through 73.026 mm (2"⅞) Tubing (9) (i), goes through the Transport Assembly (TA) (B), gets into the Free Mandrel Assembly (FMA) (C), reaches the Upper Formation Injection Valve (18) and comes out as controlled fluid towards the Upper Formation through the Middle Plug (17). The fluid goes on through the Annular Space (e6) and the Spacer Injection Outlet Perforation (31). Then it channels through the FBHA (D) Vertical Passages (C2), the Annular Spaces (e9), (e10) and (e11), and the Rupture Disc Passage (42). Simultaneously, the other injection fluid stream that goes into the Upper Mandrel, flows through the Annular Space (e7), the Middle Plug (17) Vertical Passages (C1) until it reaches the upper end of the Lower Formation Injection Valve (21) which controls the fluid to be injected in the Lower Formation. The fluid goes through the Lower Plug (22) and continues through the inside of the Telescopic Union (37 and 39), the Injection Tube (40) and the Injector Plug (41) inner passage. Meanwhile the Annular Spaces (e1), (e2) and the vertical passages (C3) are kept without pressure (white space).

Figure 9:
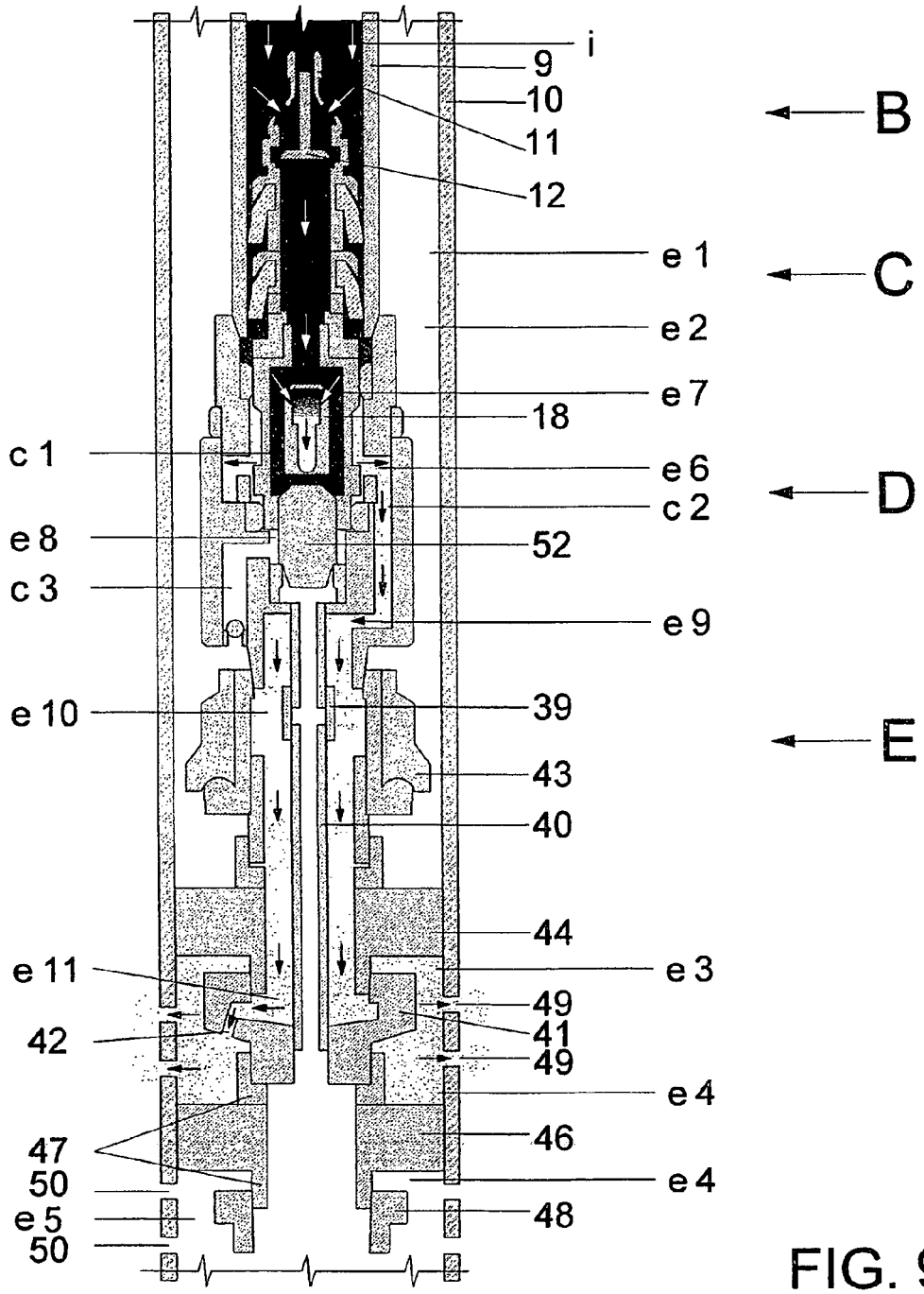

FIG. 9 is an elevational longitudinal view. It only shows the injection in the upper formation of the invention layout. The Transport Assembly (TA) (B), Free Mandrel Assembly (FMA) (C), Fixed Bottom Hole Assembly (FBH) (D) and Complementary Assembly (CA) (E) are represented while showing operative hydraulic flows. The Upper Formation Injection Valve (18) is regulating the flow and the Lower Formation Injection Valve (21) is replaced by a Blind Lower Injection Valve (52).

The central passage (corresponding to the Lower Formation circuit) is shown without pressure or fluid (white space). Consequently, the Injection Plant pressure acts through 73.026 mm (2"⅞) Tubing (9) (i), as the regulated fluid is injected to the Upper Formation through the Casing Upper Formation Perforations (49). Through the Annular Spaces (e1), (e2) and the passage (C3) there is no fluid circulation. There is only hydrostatic pressure (white space).

Figure 10:
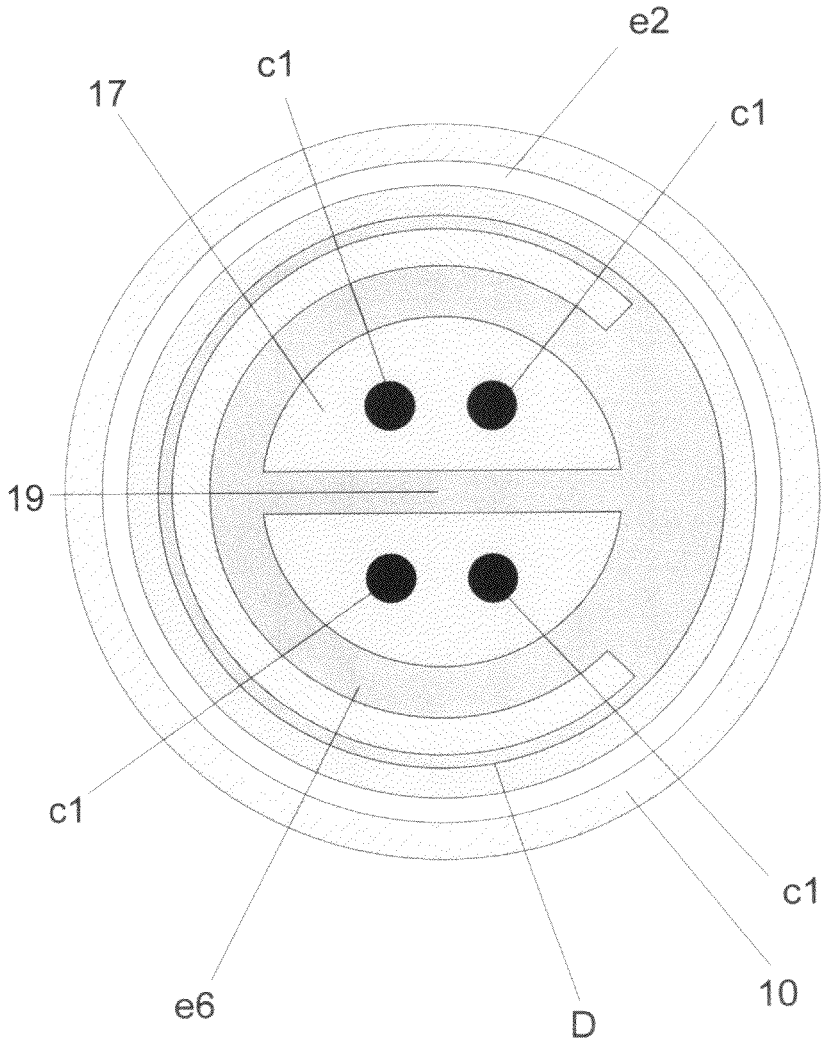

FIG. 10, a transverse cross sectional view on line III-III (FIG. 1), shows the Upper Formation injection fluid in the Middle Plug (17) Radial Passage plane (19), the Fixed Bottom Hole Assembly (FBHA) (D), Vertical Passages (C1) and Casing (10). The Annular Spaces (e2) (white space) and (e6) with the Upper Formation Injection Fluid are also shown.

The Plant injection fluid circulation goes through the Middle Plug (17) Vertical Passages (C1) and comes out regulated through the Middle Plug (17) Radial Passage (19) to the Annular Space (e6)

Figure 11:
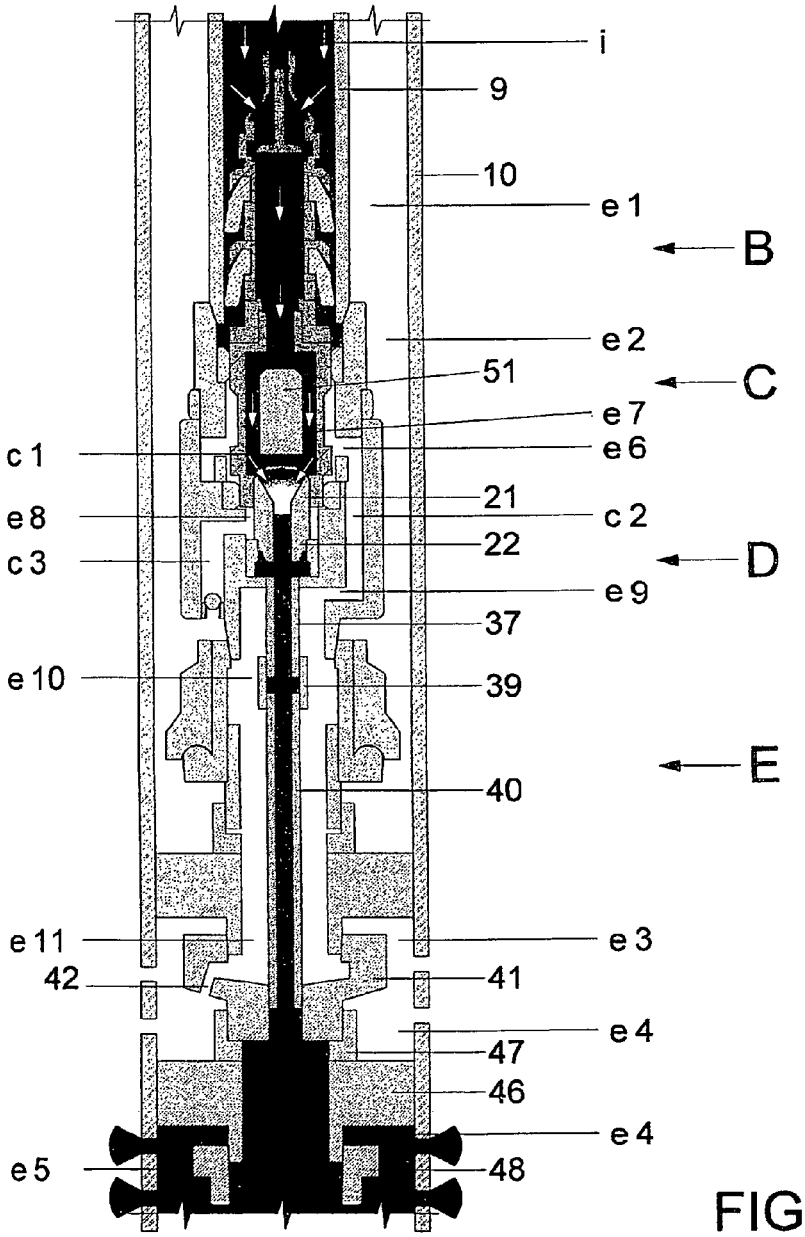

FIG. 11 is an elevational longitudinal view. It shows the injection in the Lower Formation of the invention layout. In this Figure, The Transport Assembly (TA) (B), Free Mandrel Assembly (FMA) (C), Fixed Bottom Hole (FBHA) (D) and Complementary (E) Assemblies are represented while showing operative hydraulic flows in the Annular Spaces (e1), (e2) and the passage (C3) there is no pressure (white space) as only the Lower Injection Formation flow is represented. The injection fluid that enters through 73.026 mm (2"718) (9) (i) goes through the Transport Assembly (TA) (B) and comes into the Free Mandrel Assembly (FMA) (C) and reaches the Blind Upper Valve (51). The Annular Space (e6), the FBHA (D) vertical passages (C2), the Annular Spaces (e9), (e10) and (e11) and the Rupture Disc passage (42) have no pressure.

At the same time, the other injection fluid stream flows through the Annular Space (e7) and Vertical Passages (C1) until it reaches the upper end of the Lower Formation Injection Valve (21), which controls the fluid to be injected in the Lower Formation. Lower injection fluid stream goes through the Lower Plug (22) and continues through the interior of the Telescopic Union (37 and 39), Injection Tube (40), Injector Plug (41) inner passage, 60.325 (2"⅜) (47) Tubing, Lower Packer F.H. (46), the 60.325 mm (2"⅜) tubing (47) and Shear Out (48). Meanwhile, the Annular Spaces (e1)) and (e2), and the vertical passage (C3) are kept without pressure (white space).

Figure 12:
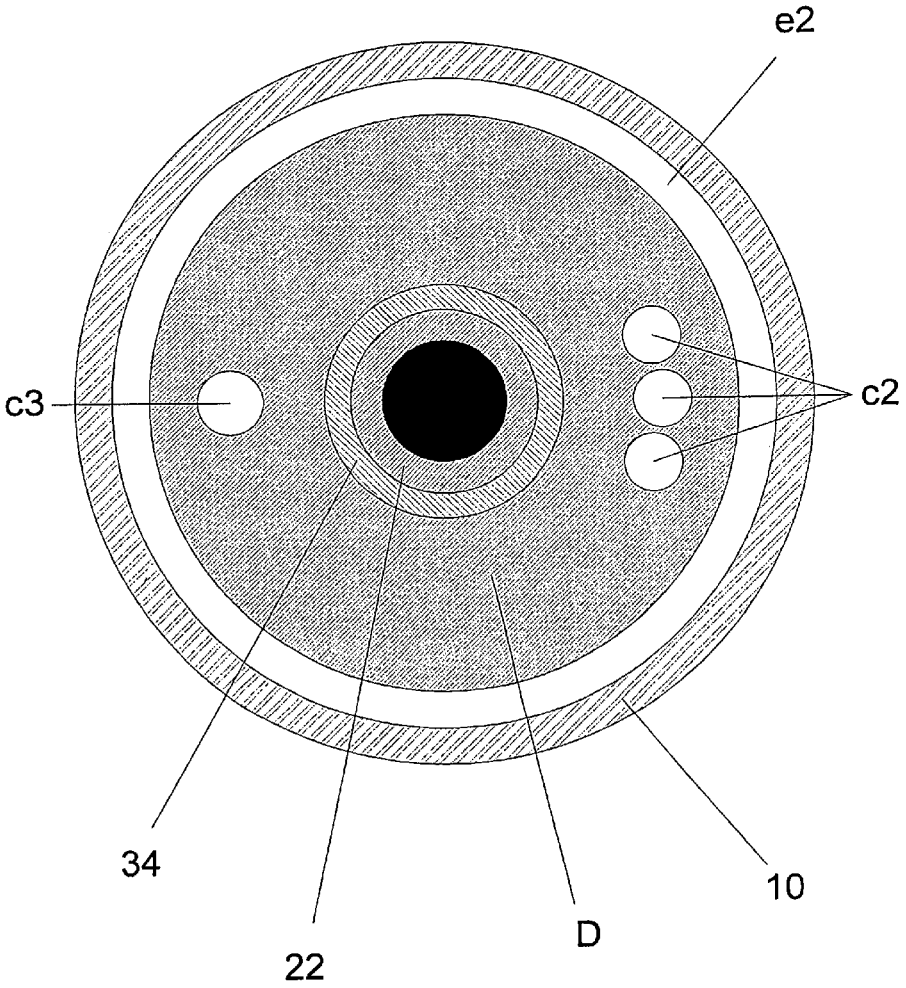

FIG. 12, a transverse cross-sectional view on line IV-IV (FIG. 1), shows lower formation fluid flowing out of the Lower Formation Injection Valve (21). As in the previous FIG. 11) the Casing (10), the Fixed Bottom Hole Assembly (FBHA) (D) and the Lower Plug (22) are also shown together with (C2) and (C3) (white space) Vertical Passages, and the Annular Space (e2) (white space).

Figure 13:
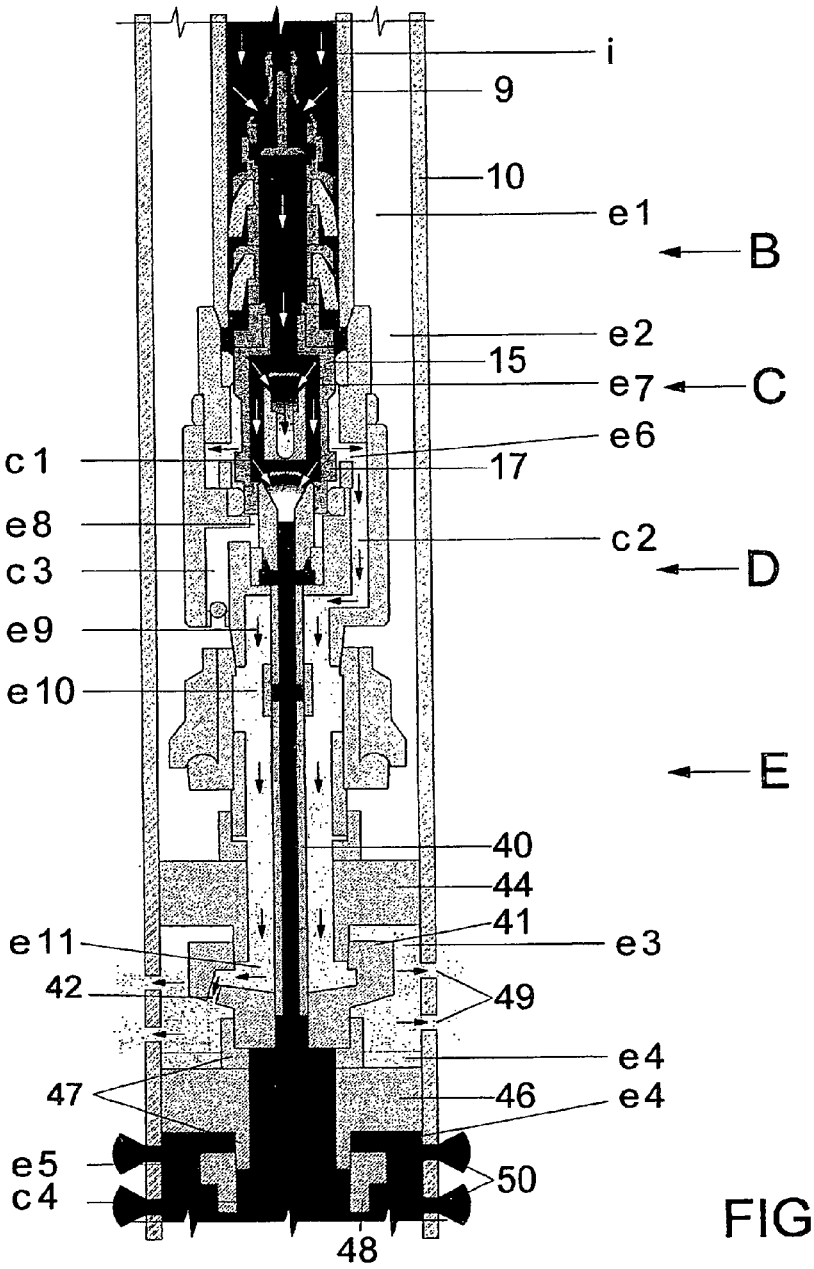

FIG. 13 an elevational longitudinal view. It shows simultaneous injection in both formations. The incoming plant fluid is controlled by the corresponding Upper Injection Formation Valve (18) and Lower Injection Formation Valve (21). The Transport Assembly (TA) (B), Free Mandrel Assembly (FMA) (C), inserted in the Fixed Bottom Hole (FBHA) (D) and Complementary Assemblies (CA) (E) are represented while showing operative hydraulic flows.

In the Annular Spaces (e1)) and (e2), and Vertical Passage (C3) there is no pressure as simultaneous Injection in the Upper and Lower Formations with regulated fluids are represented here. Upper Formation Injection Valve (18) and Lower Formation Injection Valve (21) are regulating injection fluids in both formations. Consequently, the injection fluid enters the 73.026 mm (2"⅞) Tubing (9) (i), goes through the Transport Assembly (TA) (B) and flows into the Free Mandrel Assembly (FMA) (C) through the Outer Jacket (15) and reaches the Upper Formation Injection Valve (18) from this lower end flows the upper formation regulated fluid. The injection fluid flows through the Middle Plug (17) Vertical Passages (C1) reaches the Lower Formation Injection Valve (21) that releases the regulated fluid to inject in the Lower Formation.

To complete the regulated fluid circuit to be injected in the Upper Formation, as shown in FIGS. 9 and 13), this fluid course comes out of the Rupture Disc Passage (42) until the fluid gets into the chamber delimited as follows:

1—At the upper end by the lower side of the Upper Packer F. H. (44)

2—On the outer side by the Casing (10)

3—On the inner side by the Injection Tube (40) and Injector Plug (41)

4—At the lower end by the upper side of the Lower Packer F. H. (46)

That is to say, the regulated fluid is forced to go through the Casing Upper Formation Perforations (49) to the Upper Formation.

To complete the regulated fluid circuit to be injected in the Lower Formation as shown in FIGS. 11 and 13) this fluid comes out of the Injector Plug central passage (41), 60.325 mm (2"⅜) Tubing (47), Lower Packer (46) F. H. inner passages, 60.325 mm (2"⅜) Tubing (47), and Shear Out (48), until it gets into the chamber delimited as follows:

1—At the upper end by the lower side of the Lower Packer (46)

2—On the outer side by the Casing (10)

3—On the inner side by the 60.325 mm (2"⅜) Tubing and the Shear Out (48)

4—At the lower end by the bottom hole

Figure 14:
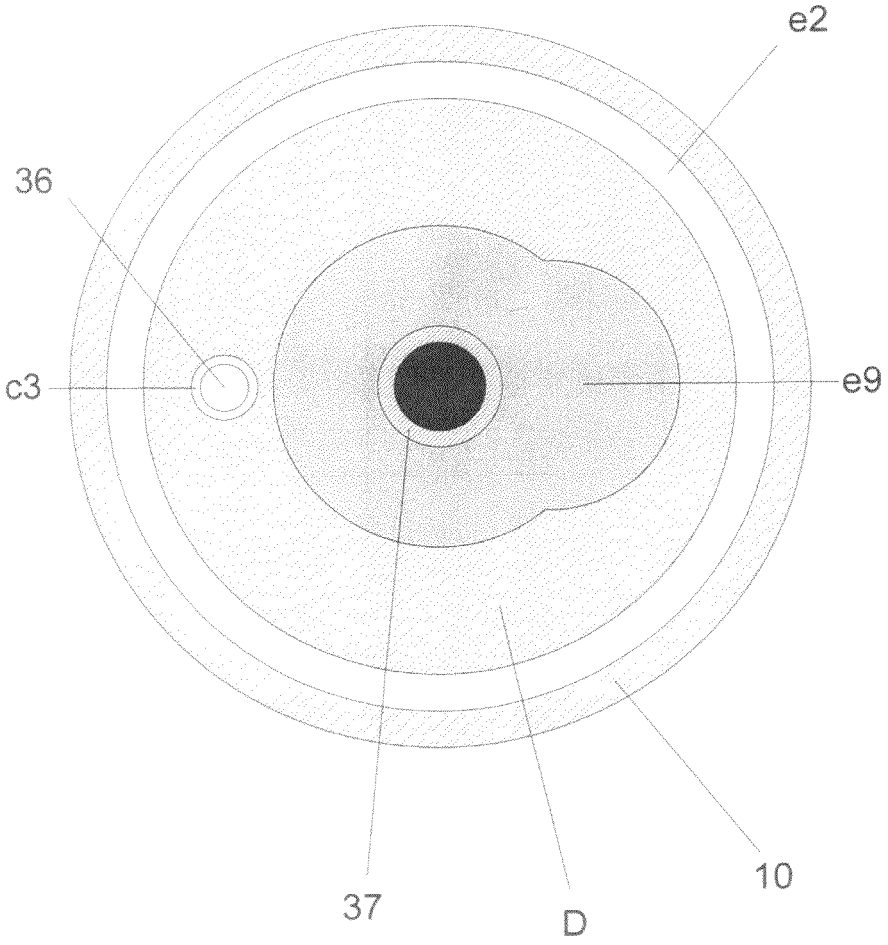

That is to say, the regulated fluid is forced to go through the Casing Lower Formation Perforations (50) and enter the Lower Formation, FIG. 14, a transverse cross-sectional view on line V-V (FIG. 1), corresponds to Upper and Lower Formation simultaneous injection at the height of the Casing Protective Valve (36) of the Fixed Bottom Hole Assembly (D) lower end. Upper Formation injection fluid goes through the Annular Space (e9) defined by the FBHA (D), inner diameter and the outer diameter of the inner body of the Telescopic Union (37) and the Lower Formation injection fluid goes through the inside of the Telescopic Union (37). Vertical Passages (C3) and Annular Space (e2) are without pressure (white space)

Figure 15:
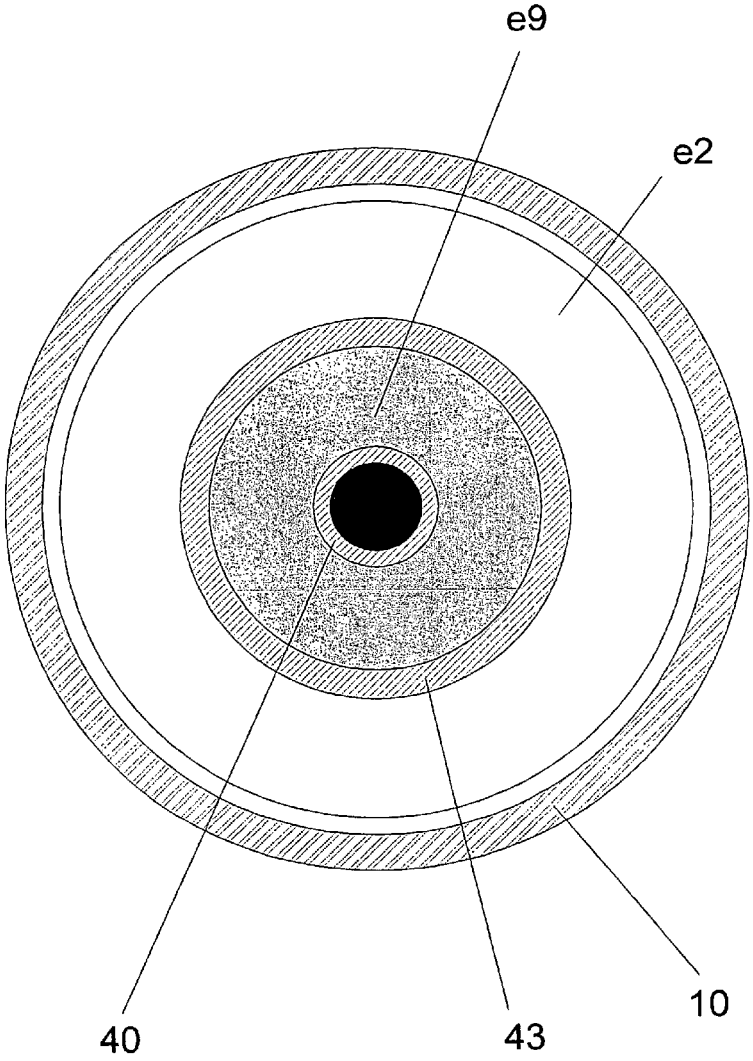

FIG. 15, a transverse cross-sectional view on line VI-VI (FIG. 1), corresponds to the lower part of the Fixed Bottom Hole Assembly (D) below the Casing Protective Valve (36) with the simultaneous injection fluids of Annular Space (e9) acting in the Upper injection fluid and Lower Formation fluid through the inside of the Injection Tube (40). Also, Annular Space (e2) is without pressure (white space)

Figure 16:
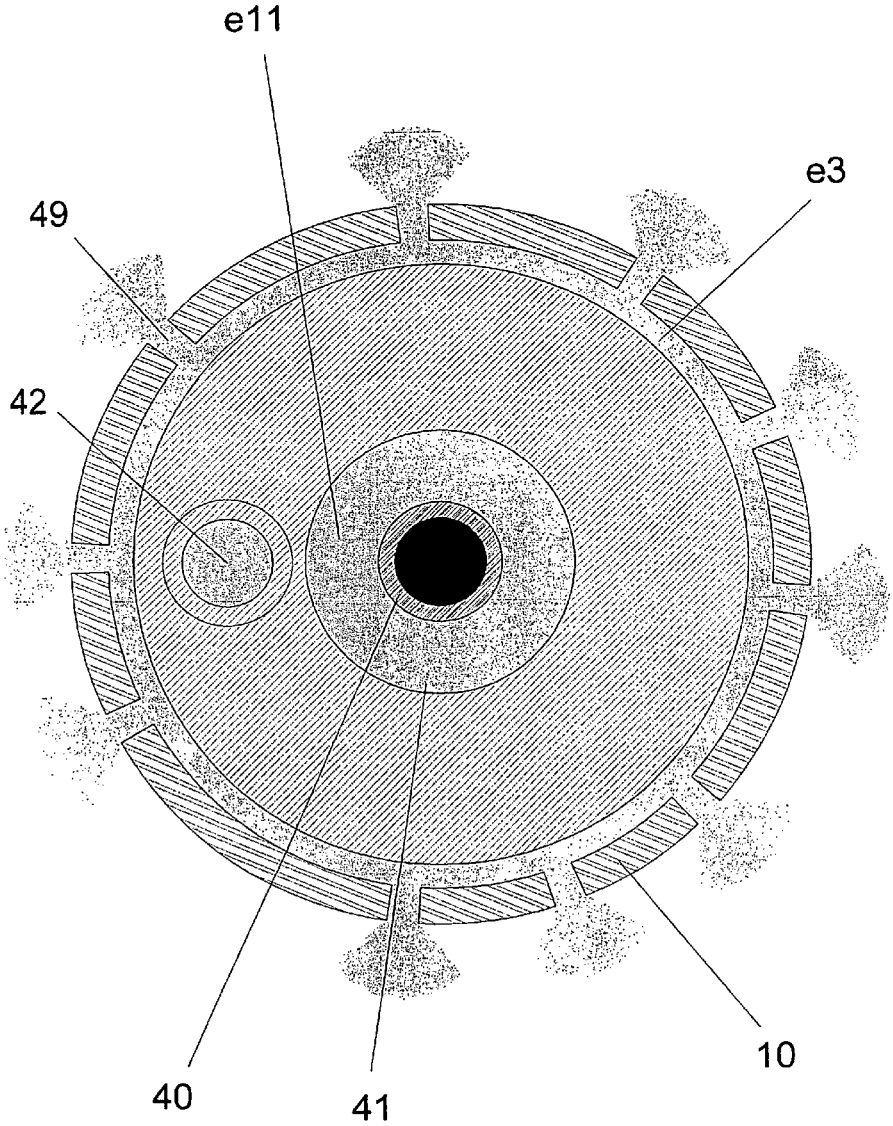

FIG. 16, a transverse cross-sectional view on line VII-VII (FIG. 1), shows Upper and Lower Formation injection fluid and flow in the Injector Plug (41) plane through the Rupture Disc passage (42). Casing Upper Formation Perforations (49), Injection Tube (40) and the Injector Plug (41) together with Annular Spaces (e3) and (e11) can also be seen. Lower Formation fluid circulates through the inside of the Injection Tube (40)

Figure 17:
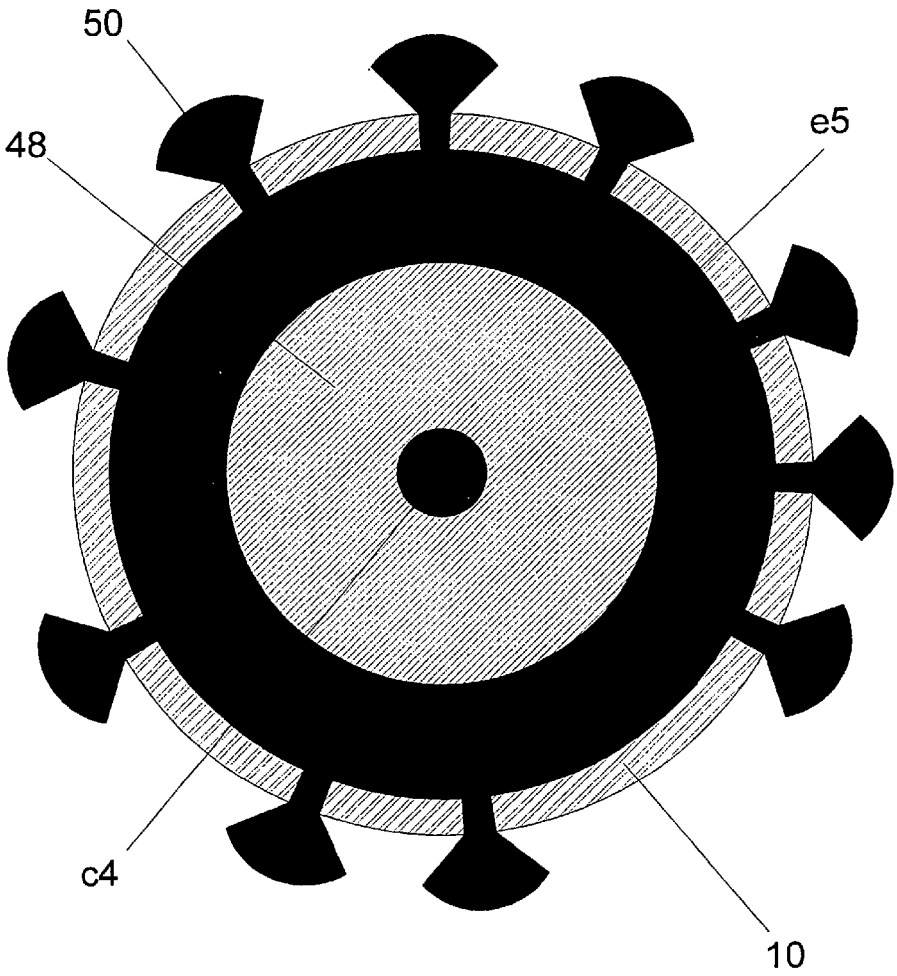

FIG. 17, a transverse cross-sectional view on line VIII-VIII (FIG. 1), only shows Lower Formation injection and fluid circulation in the Shear Out (48) passage plane and Casing Lower Formation Perforations (50) in that area. Annular Space (e5) and the Shear Out inner passage (C4) are also shown.

Figure 18:
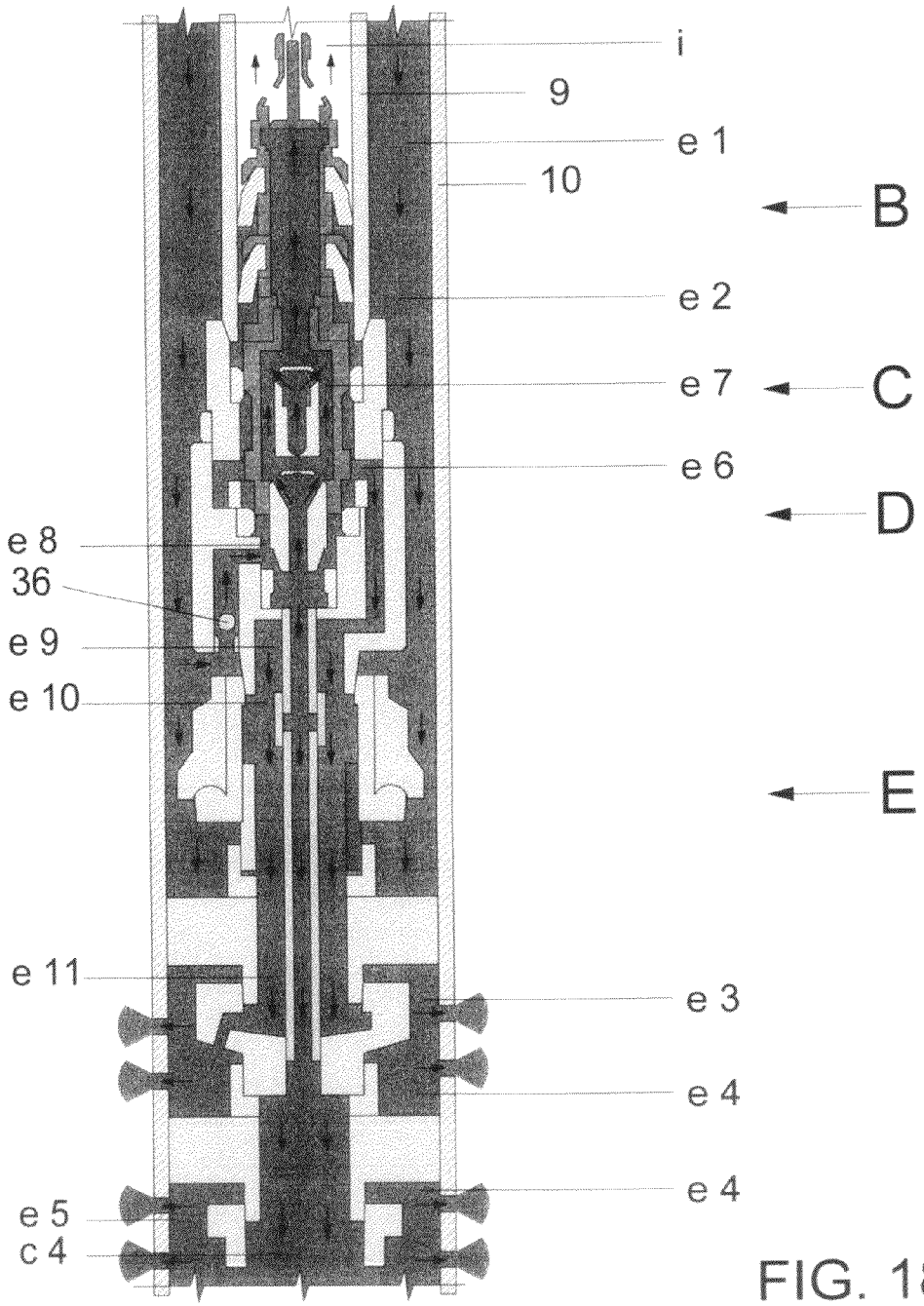

FIG. 18 is an elevational longitudinal view. It represents fluid distribution during the Free Mandrel Assembly (FMA) (C) upstroke while the low pressure fluid is injecting in both formations without flow control. It is only when the Free Mandrel Assembly (FMA) (C), together with the Transport Assembly (TA) (B) is inserted in its position inside the Fixed Bottom Hole Assembly (FBHA) (D), that the injection in both formations is controlled. FIG. 18 represents the recovery chamber where it can be seen how low pressure fluid is injected through the Annular Space (e1)) to recover the TA (B) and the FMA (C). The initial upstroke is shown.

Fluid with the necessary pressure to perform the TA and FMA upstroke has to be injected through the Annular Space (e1). This fluid enters through the Casing Protective Valve (36). This makes the TA (B) and the FMA (C) move up to the surface where they will finally insert into the Catcher (2). Fluid with a pressure slightly lower than injection pressure flows over these assemblies. Low pressure fluid pressurizes both formations This particularity has already been mentioned as a technical operational advantage of the invention because the formations are never depressurized.

Figure 19:
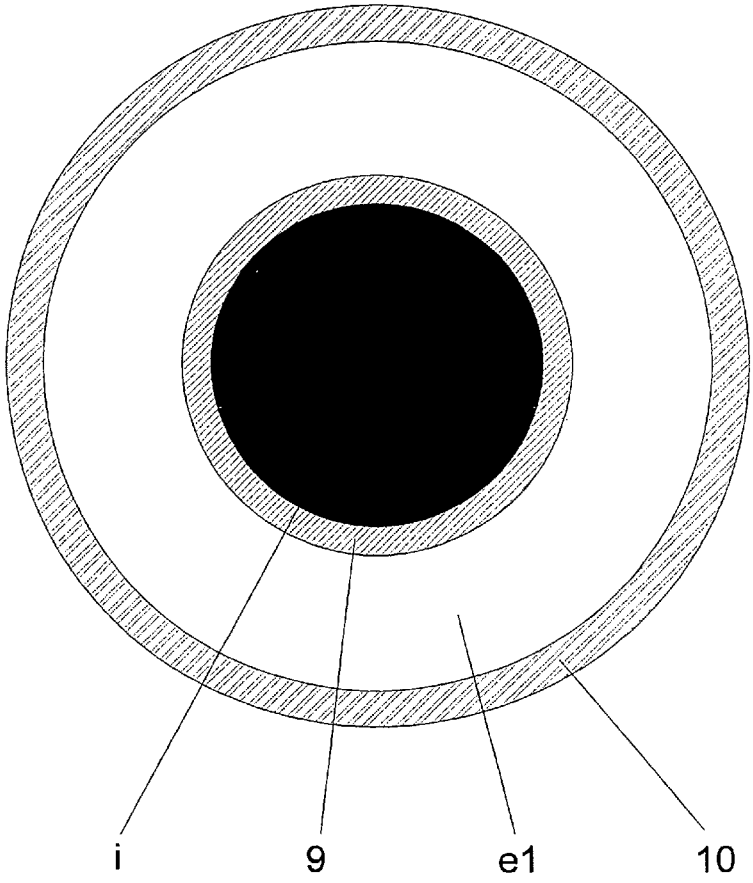

FIG. 19 shows a transverse cross-sectional view on line I-I (FIG. 1) with fluid circulation in simultaneous injection process in both formations. This takes place at the Well Head (8). The Casing (10) and the 73.026 mm (2"⅞) Tubing (9) (i) are shown. There is only hydrostatic pressure (white space) in the Annular Space between them (e1). There is injection fluid in the inside of the Tubing (9) (i).

Figure 20:
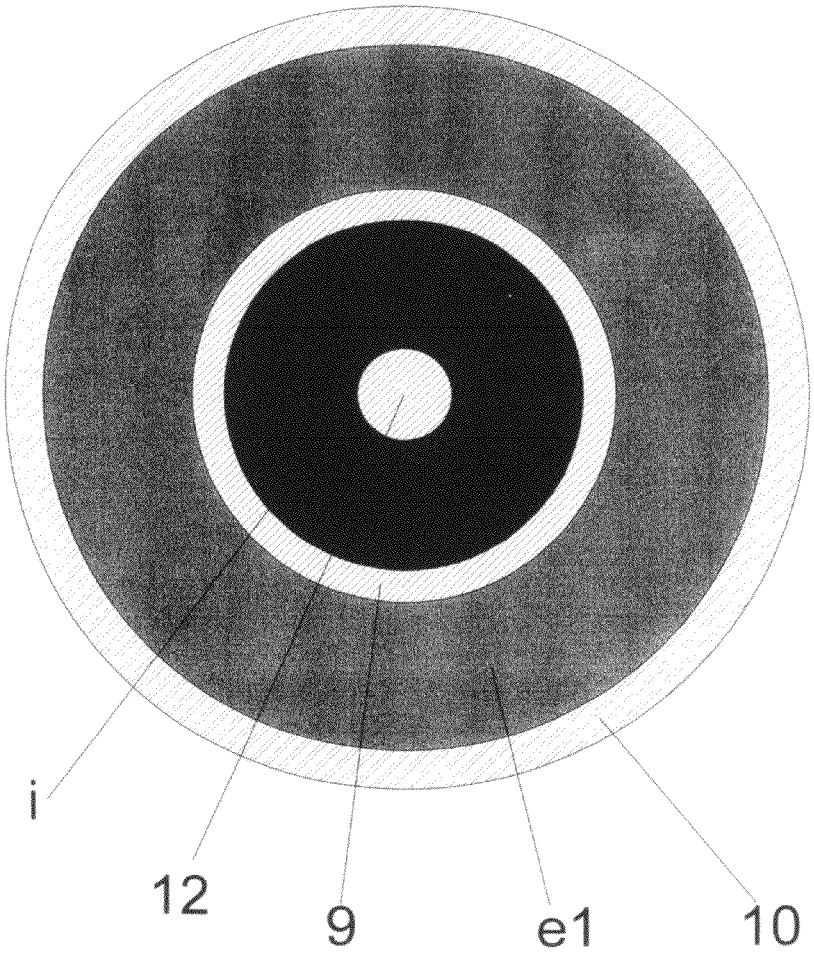

FIG. 20, a transverse cross-sectional view on line II-II (FIG. 1), shows fluid circulation in the with Free Mandrel Assembly upstroke. Fluid displaced by the Transport Assembly (TA) (B) together with Free Mandrel Assembly (FMA) (C) flows inside the 73.026 mm (2"⅞) Tubing (9) (i), and the low pressure fluid released by the Impeller Circulation Pump (5), flows through Annular Space (e1). It also shows Retention Valve (12)

Figure 21:
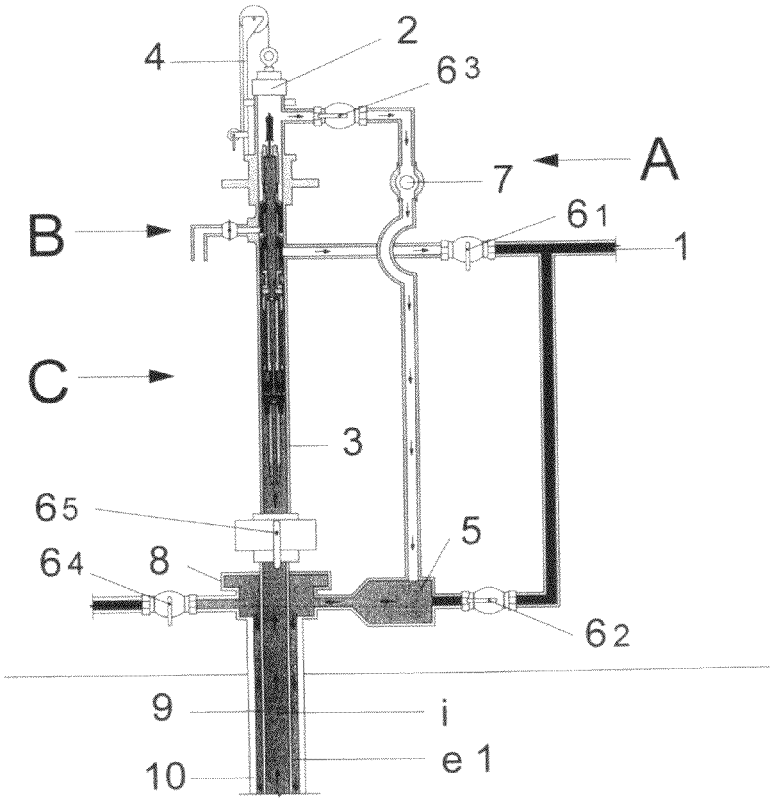
Figure 22:
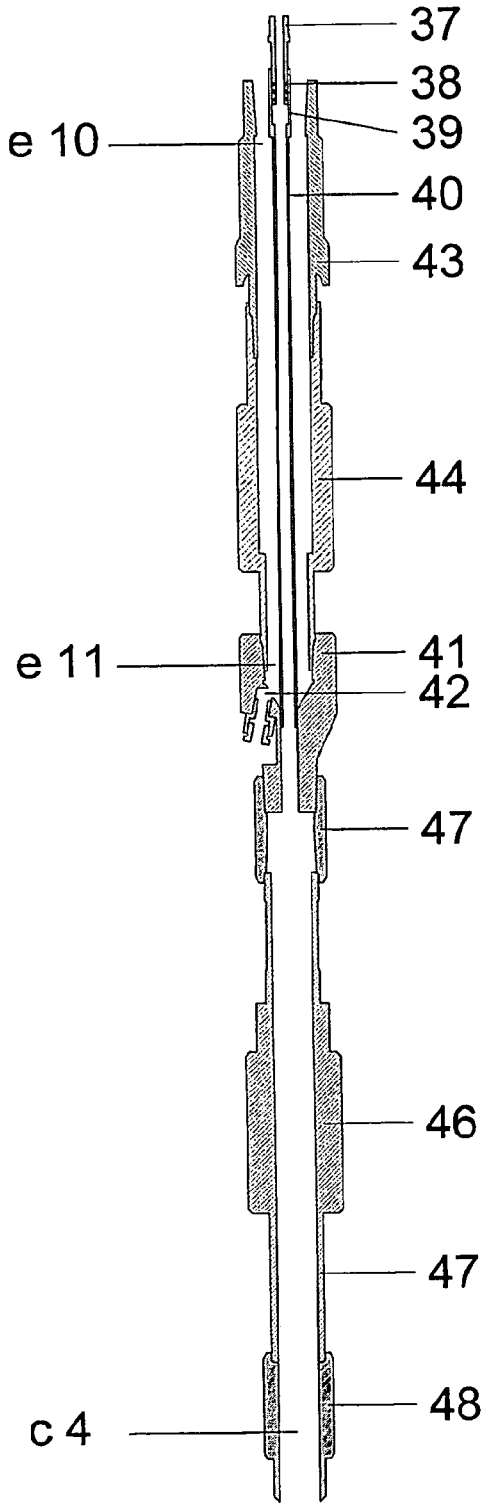

FIG. 21 is an elevational longitudinal view of the Surface Assembly when the Transport Assembly (TA) (B) together with the Free Mandrel Assembly (FMA) (C) are finishing their upstroke and arriving at the Lubricator (3). Fluid circulations are also shown FIG. 22 is an elevational longitudinal view of the general layout of the Complementary Assembly (CE) (E), It shows their components, as follows:

1 Internal components screwed at the central lower end of Fixed Bottom Hole Assembly (FBHA) (D): Telescopic Union Inner Body (37), Telescopic Union Seal Ring (38), Telescopic Union Outer Body (39), Injection Tube (40), screwed in its lower end to the Injector Plug (41). All of them are designed-to-measure parts for the Free Mandrel System, Protected Casing.

2 External components screwed on the lower end of the Fix Bottom Hole Assembly (FBHA) D screwed to the upper end of On-Off Sealing Connector (43) which, in its lower end is screwed to the upper end of Upper Packer F. H. (44) (both parts are of common use in the petroleum industry). The Injector Plug (41) screws in the Upper Packer F.H. (44) lower end. The Injector Plug (41) is a designed-to-measure part of the Free Mandrel System, Protected Casing. The Injector Plug (41) contains the Rupture Disc Passage (42). The Injector Plug (41) is also screwed, in its lower end, to the upper end of the last 60.235 mm (2"⅜) Tubing (47) required quantity to separate both packers in the injector well. At the lower end of 60.235 mm (2"⅜) Tubing (47) string, the Lower Packer F.H. (46) is screwed in its upper end. Another section of the 60.235 mm (2"⅜) Tubing (47) is connected to the Lower Packer F. H. (46) with the Shear Out (48)

DETAILED DESCRIPTION OF THE INVENTION

According to the scheme represented in FIG. 1 of the Free Mandrel System, Protected Casing, the invention layout is composed of:

A—Surface Assembly (SA)
B— Transport Assembly (TA)
C— Free Mandrel Assembly (FMA)
D—Fixed Bottom Hole Assembly (FBHA)
E—Complementary Assembly (CA)

1-(A)—Surface Assembly (SA):

It is schematically represented in FIG. 2. It is the assembly which comprises standard parts such as valves ($\mathbf{6}_1$), ($\mathbf{6}_2$), ($\mathbf{6}_3$), ($\mathbf{6}_4$), ($\mathbf{6}_5$,), (7) and (8), properly laid out to perform the required operations of the Free Mandrel System, Protected Casing, with the following additional parts designed-to-measure: the Lubricator (3) with the Catcher (2), the Mast (4) and the Impeller Circulation Pump (5), a low pressure pump, with no movable parts which makes the system work.

The SA is screwed over the Well Head (8) in the 73.026 mm (2"⅞) Full Passage Standard Injection Valve ($\mathbf{6}_5$). The Lubricator (3) with the Mast (4) and the Catcher (2) in its lower end is screwed on Standard Valve ($\mathbf{6}_5$).

Injection Fluid comes from the Water Injection Plant through Pipeline (1) which separates into two branches: the first branch goes into the SA (A) central passage into the well through Standard Valve ($\mathbf{6}_1$. When Standard Valve ($\mathbf{6}_1$) is open, the well can inject simultaneously in all Formations. When it is shut, it does not allow the injection fluid flow and so the well does not operate. (Stand-By stage); the second branch connects with the Impeller Circulation Pump (5) through a second valve ($\mathbf{6}_2$) which is shut during that operation. When it is open, it allows the injection fluid to flow to the Impeller Circulation Pump (5) which injects at low pressure in the Annular (e1)) to perform the FMA (C) upstroke, required to recover all installed Injection Valves. This procedure is used to drive the Impeller Circulation Pump (5) which uses this fluid as power fluid and injects a low pressure fluid in the Annular Space (e1) with the fluid it sucks from 73.026 (2"⅞) Tubing (9) (i). The Impeller Circulation Pump (5) connects to the Annular Space (e1)) through the Well Head (8).

Standard Valve ($\mathbf{6}_3$), placed at the upper end of the Lubricator (3) is kept closed during the injection in several formations. It is only opened to retrieve the FMA (C) (upstroke). The Impeller Circulation Pump (5) allows low pressure injection fluid to circulate from the Casing (10) to the 73.026 (2"⅞) Tubing (9) (i) through the Casing Protective Valve (36) for the FMA (C) upstroke to the surface. Standard Retention Valve (7) is used to orient the low pressure injection fluid into the Annular Space (e1)) and to avoid pressurizing the Lubricator (3).

When the FMA (C) upstroke starts up, the Standard Retention Valve (7) allows the fluid to be removed from the tubing as the FMA (C) moves up to the surface. The fluid pressure is slightly lower than the one that pushes the FMA (C) up to the surface and is sucked by the Impeller Circulation Pump (5) intake. This operation enables low pressure circulation to drive the Transport Assembly (B) together with the Free Mandrel Assembly (C) in their upstroke from the FBHA (D) until it is trapped in the Catcher (2).

Valve ($\mathbf{6}_1$) is kept open for the down stroke whereas Valves ($\mathbf{6}_2$), ($\mathbf{6}_3$) and ($\mathbf{6}_4$) are kept shut. The injection fluid pushes and the FMA (C) inserts into the FBHA (D) while automatically beginning the selective injection in both Upper and Lower Formations For the down stroke operation, a flow, not larger than 400 $m^3$/a day, is recommended to go through Valve ($\mathbf{6}_1$) to prevent the FMA (C) from inserting into the FBHA (D) with excessive impact.

In down strokes, the Operator opens Valve ($\mathbf{6}_1$). Then, he can leave the location as the operation is completely automatic. Only in injected flows over 400 $m^3$/a day, it is necessary for the Operator to liberate the flow completely after the FMA (C) is inserted in the FBHA (D) to leave the well in ideal operating conditions.

The third Valve ($\mathbf{6}_3$) is placed at the Lubricator (3) outlet and is closed while operating. When it is open, it allows the 73.026 (2"⅞) Tubing (9) (i) fluid to re-circulate to the Annular (e1)) for the FMA (C) upstroke.

The 73.026 mm (2"⅞) Full Passage Standard Injection Valve ($\mathbf{6}_5$) connected to the Well Head (8), allows the FMA (C) to run in both strokes, and the injection and return fluids flow to retrieve the FMA (C).

2-(B)—Transport Assembly—(TA):

It is schematically represented in FIG. 3. It is one of the dynamic components that moves together with the Free Mandrel Assembly (C) from the Surface Assembly (A) to its insertion in the Fixed Bottom Hole Assembly (D) during the FMA (C) down stroke or vice versa, upstroke. The TA (B) consists of the Fishing Neck (11), a Retention Valve (12), Rubber Cups (13) and the Lower Connector (14) screwed together. The Transport Assembly (B) is used to transport the Free Mandrel Assembly (C).

The Transport Assembly (B) is designed-to-measure according to the operating requirements of the invention device and It is essential in the FMA (C) upstroke as the Rubber Cups (13) expand against the 73.026 mm (2"⅞) Tubing (9) (i) taking the utmost advantage of the fluid volume when they receive the upward injection fluid push. This push also closes the Retention Valve (12) for the greatest fluid flow efficiency.

FIG. 5 shows the Transport Assembly (B) screwed to the Free Mandrel Assembly (C) upper end. The TA (B) ends in its upper extreme in an API normalized Fishing Neck (11). which allows it to be trapped by the Catcher (2) (FIG. 2) at the end of the upstroke and detached from it at the down stroke start. In case of any inconvenience, as for example tubing leakage, the TA (B) and FMA (C) can be trapped by means of a Slickeline equipment.

The TA (B) ends, in its lower extreme, in the Lower Connector (14) where it is screwed to the Free Mandrel Assembly (C). The assembly of (B) and (C) is schematically represented in FIGS. 5 A and 7 B.

3-(C)—Free Mandrel Assembly—FMA:

It is schematically represented in FIG. 4 A/B. It is the main dynamic component of the Free Mandrel System that travels from SA (A), in its down stroke, to be inserted into the FBHA (D) (in FIG. 6) and automatically begins selective injection in different Formations. The Free Mandrel Assembly upstroke carries injection valves to be examined or removed. The FMA (C) is one of the five Assemblies composed of totally new parts. It has been graphically represented in FIGS. 4 A/B, 5 A/B, 7A, 7B, 8, 9, 11, 13 and 18.

The FMA (C) has been designed-to-measure for the operations of the Free Mandrel System, Protected Casing applied to selective injection in several Formations. As mentioned above, can be applied to several formations but, in this specific explanation, has been reduced to only two formations, an upper and a lower one, for a better comprehension. Every Mandrel contains an Injection Valve in its interior, except the Lower one which is the only one integrated by an Injection Valve designed-to-measure for this purpose. A Free Mandrel Assembly designed to inject in two formations is schematically represented in FIG. 4 A/B.

The difference between the Upper Mandrel which contains an Upper Formation Injection Valve (18) in its interior and the Lower Mandrel composed by a designed-to-measure Lower Formation Injection Valve (21) and the Lower Plug (22) can be observed in FIG. 4 A/B.

The upper end of the Upper Free Mandrel is screwed at the lower end of the Transport Assembly (B) by the Outer Jacket (15) to the Lower Connector (14). The Outer Jacket (15) closes with the FBHA (D) Upper Packer Collar (25) through the Outer Jacket Seal Ring (16), which contains the Upper Formation Injector Valve (18) in its interior and is screwed to the Middle Plug (17) at its lower end. The Middle Plug (17) closes the FBHA (D) Lower Packer Collar (32) with Middle Plug Collar Seal Ring (20).

The Lower Formation Injection Valve (21) is screwed in its upper end to the Middle Plug (17) lower end. The Lower Formation Injection Valve (21) in its lower end is screwed to the Lower Plug (22) which closes with Lower Plug Seal Rings (23) in the Seat (34) of the Fixed Bottom Hole Assembly (D) (FIG. 6)

FIG. 4 A/B shows the incoming injection fluid which comes out regulated from the Upper Formation Injection Valve (18) lower end to fulfill the upper formation required conditions, Whereas, the incoming injection fluid flows through the Annular Space (e7) limited on the outside by the Upper Mandrel Jacket (15), goes through the Middle Plug (17), Vertical Passages (C1) (only shown in FIG. 4 B), reaches the Lower Mandrel and is admitted by the Lower Formation Injection Valve (21) which transforms the fluid to fulfill the lower formation required conditions.

As it has been previously described, the Upper Mandrel, which contains the Upper Formation Injection Valve (18), receives the Plant fluid and the regulated fluid for upper formation required conditions, finally comes out from the Upper Injection Valve (18) lower end.

The incoming injection fluid moves through the annular (e7) limited on the outside by the Upper Mandrel Jacket (15) and on the inside by the Upper Formation Injection Valve (18) This fluid reaches the Lower Mandrel through the Middle Plug (17) Vertical Passages (C1) (only shown in FIG. 4B) and is admitted by the Lower Formation Injection Valve (21). That is to say, the Lower Formation Injection Valve (21) receives the incoming injection fluid and transforms it into the fluid with the necessary conditions to be injected in the Lower Formation.

4-(D)—Fixed Bottom Hole Assembly—FBHA:

It is schematically represented in FIG. 6. This Assembly is static. All of its parts are designed-to-measure for the Free Mandrel System, Protective Casing. The Workover Equipment installs it with its lower end screwed to the On-Off Sealing Connector (43) upper end, and its upper end to the first 73.026 (2"⅞) Tubing (9)*at* its lower end screwed in the string that communicates the FBHA (D) with the Well Head (8)

The FBHA (D) lodges the FMA (C) so that hydraulic circuits are complemented. They allow the Upper Packer F.H. (44) and the Lower Packer F.H. (46) to be fixed from the surface during the Free Mandrel System, Protected Casing installation, without having to resort to Slickline or Wireline equipment. When the installation is over, Selective Injection is performed in every Formation.

The FMA (C) seals the Upper Packer Collar (25) with Outer Jacket Seal Ring (16) (FIGS. 4 A/B and 6) and separates the injection fluid contained in the 73.026 mm (2"⅞) Tubing (9) (i) that enters the Upper Mandrel through the Transport Assembly (B).

The Upper Free Mandrel is provided with a Middle Plug (17) in its lower end (FIG. 4 A/B). This Middle Plug seals the Lower Packer Collar (32) with Middle Plug Seal Ring (20) (FIGS. 4 A/B and 6) and prevents the fluid regulated by the Upper Formation Injection Valve from passing to the FBHA (D) lower chamber.

The Lower Formation Injection Valve (21) receives Injection fluid through the Middle Plug (17), Vertical Passages (C1), (FIGS. 4B, 5B and 7B) regulates the flow that is required for the Lower Formation Injection, and channels it through the Lower Plug (22) (FIGS. 4 A/B, 5 A/B, 7A and 7 B)

The Casing Protective Valve (36) is located in the lower chamber of the FBHA (D) (FIG. 6). The Casing Protective Valve (36) allows low pressure fluid passage to go through the Annular Space (e1)) to 73.026 (2"⅞) Tubing (9) (i) Interior (Direct) but prevents the high pressure of injection fluid from passing from the 73.026 mm (2"⅞) Tubing (i) Interior (Direct) to the Annular Space (e1)) thus keeping the Casing (10) totally isolated from injection fluid high pressure and contact. In the upstroke, the low pressure fluid impulses the Free Mandrel Assembly (C) up to remove injection valves.

FIGS. 7 A and B represent two views of the TA (C) assembled together with the FMA (C) inserted in the FBHA (D) in operating position, that is to say, ready to inject selectively in both Formations.

5-(E)—Complementary Assembly—CA:

The CA (E) has been schematically represented in FIG. 22. It is screwed in the lower part of the FBHA (D). It is composed of specific parts that correspond to the invention equipment design. They are complemented by other standard parts of common use in the Petroleum Industry.

On the outside, the lower part of the FBHA (D) screws in the upper part of On-Off Sealing Connector (43) which, in its lower part screws in the Upper Packer F.H. (44) upper end (44). Both are standard parts of common use in the petroleum industry. The Injector Plug (41) screws in the Upper Packer F.H. (44) lower part. This Plug lodges the passage where the Rupture Disc is located (42). The Injector Plug is another designed-to-measure part of the Free Mandrel System, Protected Casing.

This Rupture Disc (42) is used to fix the Upper Packer F.H. (44) and, once it has been fixed, pressure is raised until the Rupture Disc bursts and enables the circuit to perform Upper Formation Injection.

The Telescopic Union Inner Body (37) is screwed to the FBHA (D) internally and in a concentric pattern. It slides and seals by means of Telescopic Union Seal Rings (38), the inside of the Telescopic Union Outer Body (39). The Telescopic Union has two functions:

I) When the Upper Packer F.H. (44) is fixed, there is a longitudinal displacement that is absorbed by the Telescopic Union.

II) The Telescopic Union allows On-Off Sealing Connector (43) rotation and longitudinal displacement to remove the FBHA (D) with the tubing string.

The Injection Tube (40) is screwed in the lower part of the Telescopic Union Outer Body (39) and in the lower end of the Injector Plug (41). These three parts, Telescopic Union Outer Body (39), Injection Tube (40) and Injector Plug (41) are designed-to-measure for the Free Mandrel System, Protected Casing.

The 60.325 mm (2"⅜) (47) Tubing that connect the Injector Plug (41) with the Lower Packer F.H. (46) are schematically represented in FIGS. 1 and 22). The required quantity of 60.325 mm (2"⅜) (47) to separate both packers are screwed in the lower part of the Injector Plug (41) and the Lower Packer F.H. (46), in its upper part.

Other sections of the 60.325 mm (2"⅜) (47) Tubing connect the Lower Packer F.H. (46) with the Shear Out (48).

The 60.325 mm (2"3/8) (47) Tubing is screwed in the lower part of the Lower Packer F.H. (46) and, at the other end, in the upper part of the Shear Out (48) which is also used to fix the Lower Packer F.H. (46). This circuit is closed by the Shear Out (48) interior ball that increases pressure in the 60.325 mm (2"3/8) Tubing (47). Once the Lower Packer F.H (46) is fixed, pressure continues increasing until the Shear Out (48) ball is displaced thus enabling the circuit to perform the Lower Formation Injection.

Assembly Sequence for the Invention Equipment Installation:

A) The assembly sequence of the fixed designed-to-measure components of the Free Mandrel System, Protective Casing and standard parts to be installed at the Well Head (8) is the following:

I) The Shear Out (48) (FIGS. 1 and 22) is assembled, ball included, in the 60.325 mm (2"3/8) (47) Tubing.

II) The 60.325 mm (2"3/8) (47) Tubing is screwed with the Lower Packer (46). (FIGS. 1 and 22)

III) The 60.325 mm (2"3/8) Tubing (47) required for the separation between the Formations to be injected are screwed to the upper end of the Lower Packer.

IV) The Injector Plug (41) (FIGS. 1 and 22) is screwed to the last 60.325 mm (2"3/8) Tubing (47).

The FBHA (D), factory assembled, is screwed to the CA (E) down to Injector Plug (41) (FIGS. 1 and 22) including the Rupture Disc with the proper torque so that the Workover Equipment screws then Injector Plug (41) on the 60.325 mm (2"3/8) Tubing upper end (47), required by the well to comprise the distance of the Casing Upper Formation Perforations (49)

V) The required quantity of 73.026 mm (2"7/8) Tubing (9) to reach the surface and to be screwed in the Full Passage Standard Injection Valve is assembled to the FBHA (D) upper end.

VI) The Lubricator (3) will be installed on the 73.026 mm (2"7/8) Tubing Full Passage Standard Injection Valve ($\mathbf{6}_5$)

VII) The Mast (4) can be left assembled in the Lubricator or will be placed whenever a change of the Free Mandrel Assembly (C) is necessary. The other components of the SA (A) are assembled as indicated in FIG. 2.

B) Once the fixed components of the Free Mandrel System, Protective Casing are assembled in the well, additional operations are required to get the Free Mandrel System, Protected Casing installation ready to inject in several formations. The descriptions of these operations are the following:

1::1 Verification of the Tubing String Water Tightness

As the complete Tubing String is assembled, water tightness tests are performed using the Full Blind Mandrel Assembly (c). (Not illustrated). The Full Blind Mandrel Assembly (C) is the one with a Blind Upper Injection Valve (51) in its Upper Mandrel and a Blind Lower Injection Valve (52) in its Lower Mandrel. Once the 73.026 mm (2"7/8) Tubing (9) (i) has been assembled up to surface, its water tightness is tested. The Well Head pressure is increased up to 3000 psi; the valve is closed and, for 20 minutes, it is necessary to verify that it keeps constant. Once tubing water tightness testing has been satisfactory, the Full Blind Mandrel Assembly is removed.

1::2 Lower Packer (46) Fixing

The FMA (C) is lowered with the Blind Upper Injection Valve (51) screwed in the Middle Plug (17) upper end, and the fluid pumped by the Workover Equipment is only injected through the Lower Mandrel (Lower Formation Injection Valve (21) full passage). It pressurizes the Telescopic Union (37 and 39), the Injection Tube (40), the 60.325 mm (2" 3/8) Tubing (47) and the Shear Out (48) with ball. (This circuit is closed). As the pressure is slowly increased, the Lower Packer F.H. (46) is fixed by cutting the pins. This is perceived by the impact of Jaws against the Casing (10). The proper fixing is verified according to the Packer supplier specifications.

After that, the pressure is increased until the Shear Out (48) ball enables the Lower Formation Injection. Meanwhile, Formation admission tests are made according to the established program. The Lower Injection Circuit has no restrictions so the above mentioned tests can be performed. Pressures and volumes are also checked. During this operation, the pressure in the circuit to fix the Upper Packer (44) is null (white space).

1::3 Upper Packer F.H. (44) Fixing

The FMA (C) is removed with the Blind Upper Injection Valve (51) which is replaced by Upper Formation Injection Valve (18) without restriction and the Blind Lower Injection Valve (52) is screwed in the Middle Plug (17) lower end. In this case, when the fluid is pumped through the 73.026 mm (2"7/8) Tubing (9), (i) it is all directed to the Upper Formation Injection Circuit. This is blocked in the Injector Plug (41) by the Rupture Disc (42).

The Workover positions the Upper Packer F.H. (44) over the Casing Upper Formation Perforations (49) as the packer supplier recommends. When pressure is increased by the Workover Equipment Pump, the required pressure is reached by the rupture of the Upper Packer (44) pins and the Upper Packer F.H. (44) is fixed. Its proper position is checked according to what has been recommended by the manufacturer.

Thereon, the pressure continues to be increased until the Rupture Disc bursts and this enables the circuit to inject in the Upper Formation. Admission tests are performed at different pressures according to the defined program. The Upper Injection Circuit has no restrictions so the above mentioned tests can be performed.

1::4 Down Stroke or FMA (C) Insertion

Open Valves ($\mathbf{6}_1$) and ($\mathbf{6}_5$). Keep all the other valves closed. The FMA (C) is normally assembled for simultaneous injection with the Middle Plug (17), the Lower Plug (22) and corresponding regulated Injection Formation Valves according to the injection program. The Formation Selective Injection begins automatically when the FMA (C) arrives and inserts into the FBHA (D). After assembling the Well Head (8), the FMA (C) can be installed with the Workover Equipment Pump or with the Plant Injection Fluid. During the down stroke, fluid is injected in both formations without any type of control. In both cases, the fluid pushes the FMA (C) with the Upper and Lower Formation Injection Valves regulated according to the well Injection program until the FMA (C) inserts into the FBHA (D). At this moment, Selective Injection is automatically started in both formations according to what has been programmed. This is usually the last operation performed by the Workover Equipment.

After the first installation has been performed and once the down stroke has begun, the Operator does not need to wait for the FMA (C) to reach and insert into the FBHA (D) as it will be accomplished in 20 or 25 minutes and Selective Injection will begin automatically.

1::5 Upstroke to Recover the FMA (C) on the Surface

If for some reason, one or both injection valves need to be replaced, the upstroke is performed as follows:

Close ($\mathbf{6}_1$) Valve (FIG. 2) and partially open Valve ($\mathbf{6}_2$) and completely open Valve ($\mathbf{6}_3$). This allows Injection Fluid to flow into the Impeller Circulation Pump (5). This component drives the low pressure fluid through the Annular Space (e1), opens the Casing Protective Valve (36), goes into the FBHA (D) lower chamber and pushes the FMA (C) to the surface until it is hooked in the Catcher (2) of the SA (A). After the well is depressurized, the FMA (C) together with the TA (B) is removed by turning round the Catcher (2) and then, they are hoisted by the Mast (4).

If the well is not depressurized, the Catcher (2) cannot be turned round. For safety reasons, it is designed to block itself, even if there is low pressure. In this case, the Operator can leave and perform other activities. When the operator comes back, he will find the FMA (C) in the Catcher (2) and the Formations already pressurized.

If the operator needs to depressurize the well, he can proceed as follows:

1) Verify that the TA (B) together with the FMA (C) is hooked in the Catcher (2)
2) Verify all valves are closed
3) Open a purge valve included in the Lubricator.
4) The Lubricator will be at atmosphere pressure so the operator opens the Catcher (2) and releases the TA (B) together with the FMA (C) with the Mast (4)

At the Well Head, the following components can be replaced:

a) The Injector Valves by removing the used ones and placing new controlled units.
b) The FMA (C) with the valves already installed.

In both cases the task will be performed by the operator in a few minutes and the well will start up the selective injection in both formations. Obviously, FMA (C) replacement is faster with the valves already controlled.

1::6 Selective Injection Operation in Both Formations

The Injection Fluid reaches the Surface Assembly (A) along a Pipeline (1) fed from the Water Plant and enters the System through V1 Standard Valve ($\mathbf{6}_1$) completely open. Standard Valves ($\mathbf{6}_2$), ($\mathbf{6}_3$) and ($\mathbf{6}_4$), shown in FIG. 2, must be closed.

The 73.026 mm (2"⅞) Standard Full Passage Injection Valve ($\mathbf{6}_5$) has to be open to allow the FMA (C) to get through. The injection fluid, which enters the well through Standard Valve ($\mathbf{6}_1$), fills the Lubricator (3) (FIG. 2) and the fluid flows through 73.026 (2"⅞) Tubing (9) (i), goes through the Transport Assembly (TA) (B) and enters in the Free Mandrel Assembly (FMA) C, Upper Mandrel In the Upper Mandrel, the Upper Formation Injection Valve (18) (FIGS. 4 A/B, 5 A/B, 7A, 7B, 8, 9 and 13) intakes the injection fluid and regulates the flow that must be injected in the Upper Formation by guiding it through the Middle Plug (17) Radial Passage (19). This Upper Formation regulated fluid fills the chamber limited in the upper end by the Outer Jacket Seal Ring (16) that blocks the Upper Packer Collar (25). In the lower part, it is limited by Middle Plug Seal Ring (20) with the Lower Packer Collar (32). The Upper Formation regulated fluid is compelled to go through the Annular Space (e6) to the FBHA (D) inner side passage (C2) (FIGS. 7A, 7B, 8 and 13) through which it successively discharges in the Annular Spaces (e9), (e10) and (e11). On the outside, they remain limited with the On-Off Sealing Connector (43) (interior) and the Upper Packer (44). On the inside, it is limited by the Telescopic Union (exterior) (37 and 39) and the Injection Tube (40). At the lower end, the limit is the Injector Plug. (41). The Upper Formation regulated fluid goes out through the Rupture Disc passages (42) (FIGS. 1, 8, 9 and 13).

The Upper Formation fluid, which is regulated by the Upper Formation Injection Valve (18) (FIG. 4 A/B), is oriented through the Injector Plug (41) Rupture Disc passage (42) (FIGS. 1, 8, 9 and 13) to the chamber limited by:

I) The Upper Packer F.H. (44) lower side in the upper end (FIGS. 1, 8, 9 and 13)
II) The Well Casing (10) on the outside (FIGS. 1, 8, 9 and 13)
III) The Telescopic Union (37 and 39) and the Injector Tube (40) in the inside (FIGS. 1, 8, 9 and 13)
IV) The Lower Packer (46) upper side in the lower end (FIGS. 1, 9 and 13)

The Upper Formation fluid regulated by the Upper Formation Injection Valve (18) (FIGS. 1, 9 and 13) is then pushed to inject in the Upper Formation through the Casing Upper Formation Perforations (49) (FIGS. 9 and 13).

This is the course taken by the regulated fluid to go into the Upper Formation (FIG. 16).

Injection fluid takes up the Upper Formation Injection Valve Annular Space (e7) in the Upper Mandrel. The fluid flows through the Middle Plug (17) Vertical Passages (C1) (FIGS. 4B, 5B, 7B, 8, 11 and 13). These passages run into a chamber and the injection fluid is taken by the upper part of the Lower Formation Injection Valve (21) (FIGS. 4 *b*, 7B,11 and 13), which regulates the flow to be injected in the Lower Formation. This Lower Formation regulated fluid to be injected in the Lower Formation is conducted through the Lower Plug (22) inner part, Seat (32) inner part, Telescopic Union (37 and 39) inner part, Injection Tube (40), Injector Plug inner part (41), 60.325 mm (2"⅜) Tubing (47) and Lower Packer (46) inner part, and finally unloaded through the Shear Out (48) (FIGS. 1, 11 and 13) into the chamber limited by:

I) Lower Packer F.H. (46) lower side in the Upper end (FIGS. 1, 11 and 13)
II) The Well Casing (10) on the outside (FIGS. 1,11,13 and 17)
III) The bottom hole in the lower end The Lower Formation regulated fluid is introduced through the Casing Lower Formation Perforations (50) in the above-mentioned Formation (FIGS. 1, 11, 13 and 17).

This is the course taken by the Lower Formation regulated fluid to go into the Lower Formation FIGS. 7A and 7B show two views of the Transport Assembly (TA) (B) screwed in the upper end of the Free Mandrel Assembly (FMA) (C) inserted into the FBHA (D) and injecting selectively in both formations. Both sections show the circuits that drive fluids to every formation. The Plant Fluid is taken to be regulated by the Upper Formation Injection Valve (18) for the Upper Formation and the Lower Formation Fluid is taken to be regulated by the Lower Formation Injection Valve (21).

In FIG. 7A, the view of the TA (B) is parallel to the Middle Plug (17) Injection Passage (19).

In FIG. 7B, view of the TA (B) is perpendicular to the Middle Plug (17) Injection Passage (19). FIG. 4 shows the fluid that has been regulated for the Upper Formation required conditions.

According to the previous detailed explanations and in order to reinforce the invention operational comprehension here follows a summary of the injection fluid operative paths: Injection fluid flows through the component parts of the invention structure in two formations: Upper and Lower Formations in the simplified model adopted as an example to perform one of the possible applications of the invention.

The fluid that comes from the Plant, injection fluid, goes into the Tubing (9) (i) through the 2"⅞ Standard Full Passage Injection Valve ($\mathbf{6}_5$). To make this operation possible, the Standard Valve ($\mathbf{6}_1$) must be open and the ($\mathbf{6}_2$), ($\mathbf{6}_3$), and ($\mathbf{6}_4$) Standard valves shut. The fluid reaches the Free Mandrel Assembly (FMA) (C) (FIG. 4 A/B) through the Transport Assembly (ta) (B) (FIG. 3). Selective Injection is then performed in the two formations, Upper Formation and Lower Formation In a downward description, it can be observed that two watertight chambers have been formed. They make it possible to direct the fluid to be injected:

1—An upper chamber (FIGS. 1, 7A, 7B, 8, 9, 11 and 13) limited by the closure produced between the upper Outer Jacket Seal Ring (16) that packs in the Upper Packer Collar (25), and the Plant pressure (injection fluid) contained in the Tubing string up to this location.

2—At the same time, an Upper Mandrel chamber will also be determined. This is contained between said closure produced by the upper Outer Jacket Seal Ring (16) with the Upper Packer Collar (25) and the closure produced between the Middle Plug Seal Ring (20) with the Lower Packer Collar (32). This chamber contains the fluid to be injected in the Upper Formation with pressure regulated by Upper Formation Injection Valve (18) and channeled through the Middle Plug (17) Radial Passage (19). Both the Plant pressure, injection fluid, in the Annular Space (e7) and in the (C1) Vertical Passage and the Injection Pressure in the Upper formation coexist in this chamber. (FIGS. 1, 4 A/B, 5 A/B, 7A, 7B, 8, 9, and 13).

The Free Mandrel Assembly (FMA) (C) (FIG. 4 A/B) lodges the Upper Formation Injection Valve (18) that regulates the Upper Formation Injection flow pressure and is screwed in the Middle Plug (17) in its lower end The circuit that drives this already regulated fluid is driven (FIGS. 1, 9 and 13) through the Middle Plug (17) Radial Passage (19), Annular Space (e6), FBHA (D) Vertical Passages (C2) to Annular Spaces (e9), (e10) and (e11), Injector Plug (41) through Rupture Disc (42) passage to Annular Space limited by:

I The Upper Packer F.H. (44) lower end (FIGS. 9 and 13)

II The Lower Packer F.H. (46) upper end (FIGS. 9 and 13)

III On the outside by the Casing (10) (FIGS. 9 and 13)

The fluid to be injected goes through the Casing Upper Formation Perforations (49) and enters the Upper Formation. (FIGS. 1, 9, 13, 16).

3—The Lower chamber (FIGS. 11 and 13) is determined by the closure of the Lower Packer Collar (32) and Middle Plug Seal Ring (20), Lower Plug (22) Lower Plug Seal Ring (23) with Seat (34). The Lower Formation Injection Valve (21) admits the Plant Fluid (injection fluid) by its upper end and regulates the pressure to be injected in the Lower Formation.

Between the Upper Mandrel Jacket (15) and the outside of the Upper Formation Injection Valve (18), in the Annular Space (e7), the Plant, injection fluid feeds the Lower Formation Injection Valve (21) through the Middle Plug (17) Vertical Passages (C1). Lower Formation Injection Valve (21) transforms the pressure and the volume as requested for Lower Formation Injection.

FIGS. 11 and 13 show in the FBHA (D) the circuit that drives Lower Formation Injection regulated flow to be injected in the Lower Formation. It must go through the Lower Plug (22), Seat (34), Telescopic Union (37 and 39), Injector Tube (40) through Injector Plug (41) central passage (FIGS. 11 and 13). In the Injector Plug (41) lower end, the 60.325 mm (2" ⅜) Tubing (47) strings are screwed. These tubing connect the Injector Plug (41) with the Lower Packer F.H. (46). The 60.325 mm (2"⅜) Tubing (47) and the Shear Out (48) are screwed to the Lower Packer F.H. (46) lower end. The Lower Formation Injection fluid flows through the Casing Lower Formation Perforations (50) (FIGS. 1, 11 13 and 17).

4—The Free Mandrel Assembly Recovery Chamber (FIG. 18) is the chamber limited by the FBHA (D) inner diameter and the outside of the Lower Formation Injection Valve (21) Jacket, Annular Space (e8) (FIG. 18). The chamber is closed by the Casing Protective Valve (36). The fluid that fills the said chamber is at the pressure of the column that contains the Annular Space (e1)

To enable the Free Mandrel Assembly (C) upstroke, low pressure fluid is injected through the Annular Space (e1)) and 73.026 mm (2"⅞) Tubing 9 (i) (Direct) is depressurized by opening Standard Valve ($\mathbf{6}_3$). The Casing Protective Valve (36) opens and lets the fluid in. This fluid pushes up the Free Mandrel Assembly (C) until it is caught in the Catcher (2).

To remove the Free Mandrel Assembly (FMA) (C) together with the Transport Assembly (TA) (B), it is only necessary to operate the Surface Valves in the following way:

1—Close Standard Valve ($\mathbf{6}_1$)

2—Open Standard Valve ($\mathbf{6}_2$)

3—Open Standard Valve ($\mathbf{6}_3$)

4—Keep Standard Valve ($\mathbf{6}_4$) closed.

With this configuration, the Plant Water enters through the Impeller Circulation Pump (5) to the Annular Space (e1). This opens the Casing Protective Valves (36) allowing the fluid to enter and disconnect the Free Mandrel Assembly (FMA) (C) and the Transport Assembly (TA) (B) from the Fix Bottom Hole Assembly (FBHA) (D). From this moment on, the fluid produces the upward push that makes the Rubber Cups (13) expand and closes the Transport Assembly Valve (12) located in the Fishing Neck (11). The upward speed is proportional to the volume of the fluid injected in the Annular Space (e1). The upstroke ends with the Free Mandrel Assembly (FMA) (C) and the Transport Assembly (TA) (B) hooked together in the Catcher (2) located in the Lubricator (3).

To remove the Free Mandrel Assembly (FMA) (C) together with the Transport Assembly (TA) (B) from the well:

1) Turn Catcher (2) eye-bolt until it adopts the "Catching" position. In this position, the Catcher cage retains the assemblies when they make an impact in their upstroke.
2) Close all Surface Assembly Valves ($\mathbf{6}_1$,$\mathbf{6}_2$,$\mathbf{6}_3$,$\mathbf{6}_4$).
3) Wait until 73.026 mm (2"⅞) Tubing (9) (i) (Direct) pressure reaches zero.
4) Turn Catcher (2) 90° to remove Catcher from the Lubricator (3).
5) Raise the Free Mandrel Assembly (FMA) (C) and the Transport Assembly (TA) (B) with the Mast (4).
6) Lower the assemblies and unhook them for inspection or replacement.

To install the Free Mandrel Assembly (FMA) (C) and the Transport Assembly (B), the reverse process has to be performed:

1) All surface Valves must be shut. ($\mathbf{6}_1$ to $\mathbf{6}_5$).
2) The two assemblies are hooked together, installed in the hoisting system and then introduced in the Lubricator (3).
3) The Catcher (2) is turned 90° to close the Lubricator (3).
4) Open 73.026 (2"⅞) Standard Full Passage Injection Valve ($\mathbf{6}_1$).
5) The Catcher eye-bolt is turned to the releasing position so that the Free Mandrel Assembly (FMA) (C) and the Transport Assembly (TA) (B) unhook from the Catcher (2) and start the downward movement.
6) Valve ($\mathbf{6}_1$) is opened so that the fluid push makes the assemblies descend at a proper speed, according to the injected flow. A speed of about 70 to 85 meters/minute is considered reasonable for the down stroke. Once the two assemblies, Free Mandrel Assembly (FMA) (C) and Transport Assembly (TA) (B) are engaged in the Fixed Bottom Hole Assembly (FBHA) (D), the pressure begins to rise until it reaches the Pipeline pressure. In this moment, the system begins automatically to inject selectively in the two formations.

The invention claimed is:

1. A free mandrel system, protected casing, hydraulically driven by injection fluid to be applied in the petroleum industry for selective injection of fluids, liquids or gases, in different formations while keeping the casing isolated from fluid pressure and operated from the well head by a single person handling surface valves to set and recover all injections valves together comprising five interconnected basic assemblies:

a surface assembly (A) comprising an installation and release mast (4), a lubricator (3) with a catcher (2), required standard valves ($\mathbf{6}_1$, $\mathbf{6}_2$, $\mathbf{6}_3$, $\mathbf{6}_4$, $\mathbf{6}_5$ and 7) and an impeller circulation pump (5) to enable the operations of said surface assembly (A);

a transport assembly (B) comprising a fishing neck (11) with a retention valve (12), a pair of rubber cups (13) that slide over a central tube and a lower connector (14);

a free mandrel assembly (C), consisting of one upper mandrel with a standard upper formation injection valve (18) and a lower mandrel with a designed-to-measure lower formation injection valve (21) for the two said formations to be selectively injected;

a fixed bottom hole assembly (D), consisting of an upper body (24) with an upper packer collar (25), an upper collar seal ring (26) and a lock nut (27)*to* fix to lower body (28); a lower body seal ring (29), a spacer (30) and spacer outlet perforation (31) to inject into upper formation; lower packer collar (32) with lower packer collar seal ring (33), a seat (34) with seat seal rings (35), and laterally at least one casing protective valve (36) and fluid vertical passages (C2);

a complementary assembly (E) screwed in the lower end of said fixed bottom hole assembly (B) comprising: in its inner part a telescopic union inner body (37), an injector tube (40) and a designed-to-measure injector plug (41); in its outer part, an on-off sealing connector (43) screwed to the lower end of said fixed bottom hole assembly (D), to the upper end of standard upper packer hydraulically fixed (44), to injector plug (41) screwed to upper packer (44) lower end and in injector plug (41) lower end the necessary quantity of 60.325 mm (2"3/8) tubing to fix a lower packer hydraulically fixed (46) to separate both formations and at least one 60.325 mm (2"3/8) tubing (47) placed below lower packer hydraulically fixed (46) with a shear out (48) at its end.

2. The free mandrel system, protected casing, as in claim 1 wherein said transport assembly (B) together with said free mandrel assembly (C) move from said surface assembly (A) to be inserted in said fixed bottom hole assembly (D) automatically beginning said selective injection in said upper and lower formations.

3. The free mandrel system, protected casing, as in claim 2, wherein said selective injection uses injection fluid as power fluid keeping the formations pressurized for the setting up and simultaneous lifting of all injection valves without requiring wireline, slickline or external personnel.

4. The free mandrel system, protected casing, as in claim 1, wherein said free mandrel assembly (C) containing all injections valves for the formations to be selectively injected is raised by only one operator in about 30' by simply handling a valve set of a surface component of said free mandrel system.

5. The free mandrel system, protected casing, as in claim 1, wherein said casing protective valve (36) located in the lower chamber of the fixed bottom hole assembly (D) keeps the casing (10) totally isolated from injection fluid high pressure and contact.

6. The free mandrel system, protected casing, as in claim 1, wherein said complementary assembly (E) and said fixed bottom hole assembly (D) are static assemblies of said free mandrel system, protected casing, screwed together and installed by workover equipment.

7. The free mandrel system, protected casing, as recited in claim 1, wherein said upper (44) and lower (46) packers of said complementary assembly (E) are only fixed by workover equipment without any assistance of slickline or wireline.

8. The free mandrel system, protected casing, as in claim 1, wherein the operative fluid flowing through hydraulic circuits of said assemblies will be taken with the extended meaning of the fluid concept, comprising any kind of liquids or gases.

9. The free mandrel system, protected casing, as in claim 1, wherein said selective injection of fluids can be performed in more than both, upper and lower, formations.

* * * * *